United States Patent [19]

Bissonette

[11] 3,989,526

[45] Nov. 2, 1976

[54] PROCESSING COMPOSITIONS COMPRISING INERT TRANSITION METAL COMPLEX OXIDIZING AGENTS AND REDUCING AGENTS

[75] Inventor: Vernon Leon Bissonette, Brockport, N.Y.

[73] Assignee: Eastman Kodak Company, Rochester, N.Y.

[22] Filed: Sept. 5, 1974

[21] Appl. No.: 503,405

Related U.S. Application Data

[60] Division of Ser. No. 420,194, Nov. 28, 1973, Pat. No. 3,862,842, which is a continuation-in-part of Ser. No. 189,289, Oct. 14, 1971, abandoned, and a continuation-in-part of Ser. No. 256,072, May 23, 1972, Pat. No. 3,834,907, which is a continuation-in-part of Ser. No. 150,741, June 7, 1971, abandoned.

[52] U.S. Cl. ..... 96/48 R; 96/48 PD; 96/49; 96/54; 96/55; 96/60 R; 96/66 R; 96/66.3; 96/66.5; 252/186; 252/188; 252/188.3 R

[51] Int. Cl.[2] ..... G03C 5/24; G03C 5/32; G03C 7/00; G03C 5/30

[58] Field of Search ..... 96/48 R, 48 PD, 54, 96/55, 60 R, 60 B, 60 F, 66 R, 66 HD, 66.3, 66.5, 49; 252/186, 188, 188.3 R

[56] References Cited

UNITED STATES PATENTS

| | | | |
|---|---|---|---|
| 3,467,520 | 9/1969 | Puschel et al. | 96/53 |
| 3,656,950 | 4/1972 | Bent et al. | 96/66 R |
| 3,765,891 | 5/1952 | Travis | 96/66.3 |
| 3,862,842 | 1/1975 | Bissonette | 96/66 R |

*Primary Examiner*—David Klein
*Assistant Examiner*—Richard L. Schilling
*Attorney, Agent, or Firm*—G. E. Battist

[57] ABSTRACT

An improvement is provided in processes wherein an oxidation-reduction reaction is utilized to form an image. In one aspect of this invention, the improvement comprises employing an oxidizing agent and a reducing agent which undergo imagewise redox reaction in the presence of catalytic material, the oxidizing agent and the reducing agent being so chosen that the reaction products are noncatalytic for the oxidation-reduction reaction. In another aspect of this invention, a substitution inert metal complex is utilized as the oxidant in oxidation-reduction, image-forming processes. Novel processing compositions and photographic materials are also described.

11 Claims, 6 Drawing Figures

Figure 1:
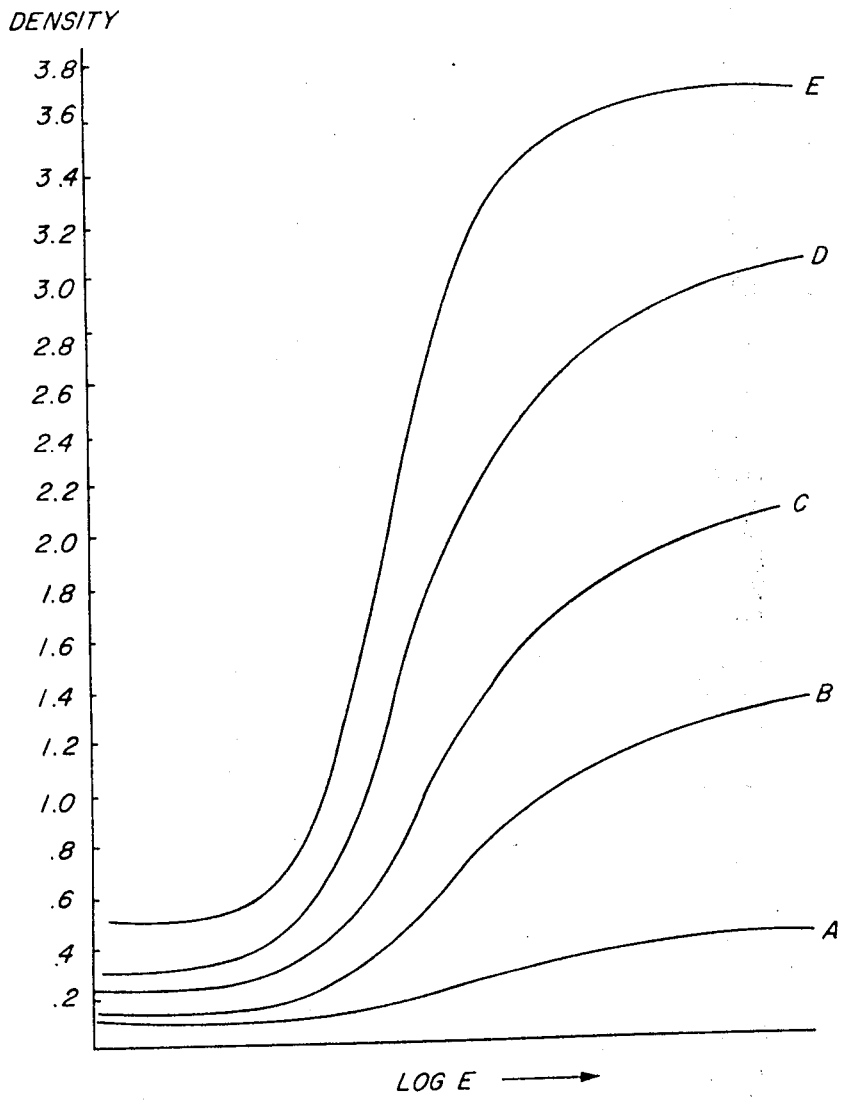

PROCESSING COMPOSITIONS COMPRISING INERT TRANSITION METAL COMPLEX OXIDIZING AGENTS AND REDUCING AGENTS

This application is a divisional application of U.S. Ser. No. 420,194 filed Nov. 28, 1973, now U.S. Pat. No. 3,862,842 which is a continuation-in-part of U.S. Ser. No. 189,289 filed Oct. 14, 1971, now abandoned, and a continuation-in-part of U.S. Ser. No. 256,072 filed May 23, 1972, now U.S. Pat. 3,834,907, which in turn is a continuation-in-part of U.S. Ser. No. 150,741 filed June 7, 1971, now abandoned, all of which are incorporated herein by reference.

This invention relates to image formation. In one aspect, it relates to image-formation processes which utilize a redox reaction. In certain other aspects, it relates to image amplification or image replacement.

A variety of image-forming systems have been described in the prior art which utilize redox reactions. Belgian Patent No. 742,768 of June 8, 1970, describes an image-amplification procedure which features the use of peroxy compounds and reducing agents, such as photographic color-developing agents. However, such redox systems are highly unstable; photographic color-developing agents are oxidized merely in the presence of air and peroxy compounds react extremely rapidly with such reducing agents. Hence, it would be desirable to provide image-forming redox systems in which the oxidizing and reducing agents are more stable.

U.S. Pat. No. 3,152,903 by Sheppard et al. issued Oct. 17, 1964, suggests various redox systems which have a physical barrier (e.g., phase separation) to prevent redox reaction. The oxidizing and reducing agents proposed undergo substantially immediate redox reaction in the absence of external catalyst when they are incorporated in an inert solvent solution. There appears to be no disclosure in this patent of a redox system which is stable in the absence of some physical barrier.

British Patent No. 777,635 published June 26, 1957, suggests photographic bleach baths which contain a cobalt(III) complex and which may contain a reducing agent. However, photographic bleach baths contain a silver halide solvent. In the presence of silver halide solvent, the cobalt complex reacts directly with the silver and does not undergo, to any significant degree, redox reaction with the reducing agent.

Photographic physical developer solutions are well-known in the art. For example, U.S. Pat. No. 2,750,292 by Dippel et al. issued June 12, 1956, describes the formation of dyes simultaneously and in situ with the formation of a metal image during physical development of a photographic element containing a metal image and a photographic coupler, with a solution containing photographic color-developing agent and a reducible metal salt. However, a serious disadvantage with physical developers is that they do not have a high degree of stability. One reason for this instability is that the reaction products of the redox reaction are catalysts for further redox reaction, i.e., the reaction is autocatalytic. It would accordingly, be desirable to provide a nonautocatalytic oxidizing-reducing agent combination.

U.S. Pat. No. 2,517,541 by Christensen issued Aug. 8, 1950, describes photographic silver halide emulsions containing amounts less than about 0.1% by weight of the wet emulsion of an alkali metal cobalticyanide. The exposed elements containing this addendum are developed in typical photographic developer solutions. The low concentrations of cobalticyanide proposed probably are necessary to avoid fogging the emulsion. Such low amounts of potassium cobalticyanide would not contribute substantially to image formation via redox reaction, even if there is a redox reaction between the cobalticyanide and the developer in areas where silver is developed. However, it is unlikely that even limited redox reaction occurs because potassium cobalticyanide does not undergo redox reaction with typical color-developing agents in the presence of predeveloped silver.

It is well-known that polymerization of photopolymers can be initiated by a radical which can be liberated through a light-catalyzed redox reaction. See Rust, "Fast Imaging Systems. Using Photopolymers", *Optical Spectra*, March/April, 1968, pp. 41–45 at p. 42. There does not, however, appear to be any suggestion in the art relative to providing a stable reducing agent-oxidizing agent combination which can be catalyzed into a redox reaction with a catalytic material.

British Patent No. 1,194,581 published June 10, 1970, describes an imaging process in which a photosensitive composition, upon exposure to light, generates nuclei of a metal which is more noble than silver and is catalytic to the electroless deposition of a nonnoble metal. An image is formed by an electroless deposition of nonnoble free metal on the nuclei. There appears to be no disclosure in this patent of a stable redox system which is nonautocatalytic.

In the photographic dye bleach system, such as described in U.S. Pat. No 2,270,118 by Gaspar issued Jan. 13, 1942, dyes are produced imagewise by treating diffusely dyed layers containing silver images with an acid solution which destroys the dye imagewise in areas where silver is present. The destruction of the dye can be accelerated with various "catalysts", such as a phenazine. The reactions in the dye bleach system appear to proceed on a stoichiometric basis. See U.S. Pat. No. 3,340,060 by Mayer et al. issued Sept. 5, 1967, col. 1, lines 18–21, noting that four silver atoms are required to destroy one azo dye group. It would be desirable to provide a photographic system which would make more efficient use of silver than in the silver dye bleach process.

British Patent No. 239,875 published Nov. 5, 1925, describes a photographic element useful in the diazo process which includes a cobalt(III) metal complex and, optionally, silver halide. This diazo image-forming process is a substitution reaction rather than a redox reaction. Further, the incorporated cobalt(III) complex fogs the silver halide.

There is a need in the art, therefore, for image-forming systems which feature a reducing-oxidizing agent combination which is relatively inert to redox reaction even when in a reactive environment, and which do not form reaction products which catalyze the redox reaction. Further, there is need in the art for redox reaction systems which can be utilized to amplify faint images or replace images with other images having a different color value. In addition, it is desirable to provide a method whereby the extremely high light sensitivity of photographic silver halide can be utilized to generate a latent or faint silver image that acts as a catalyst for a redox system to amplify or replace the silver image.

One object of this invention is to provide a method and composition for forming images.

Another object of this invention is to provide an image-forming method in which a redox reaction is utilized to produce a change in light value.

Still another object of this invention is to provide an image-forming process in which at least one of the reaction products of a redox reaction is utilized to produce a change in light value.

A further object of this invention is to provide a method for amplifying faint or invisible images.

Another object of this invention is to supplement metal images with dye images.

Still another object of this invention is to replace metallic images with dye images.

Another object of this invention is to provide a method for enhancing the quantity of dye formed by the reaction of oxidized color-developing agent with photographic color coupler in systems in which the oxidized developing agent is generated by the reaction of unoxidized color-developing agent with exposed photographic silver halide.

Other objects of this invention will be apparent from the disclosure herein and the appended claims.

In one embodiment of this invention, an improvement is provided in an image-forming process wherein an oxidation-reduction reaction is utilized to form a photographic image, which improvement comprises employing an oxidizing agent and a reducing agent which undergo redox reaction in the presence of catalytic material and which are essentially inert to oxidation-reduction reaction in the absence of a catalytic material, the oxidizing agent and the reducing agent being so chosen that the reaction products thereof are noncatalytic for the oxidation-reduction reaction.

In another embodiment of this invention, an improvement is provided in an image-forming process wherein a reaction product of an oxidation-reduction reaction is utilized to form a photographic image, which improvement comprises employing an oxidizing agent and a reducing agent which undergo imagewise redox reaction at a catalytic surface, the oxidizing agent being a complex of a metal ion with ligands which, when a test sample of the complex is dissolved at 0.1 molar concentration at 20° C in an inert solvent solution containing a 0.1 molar concentration of an uncoordinated ligand, exhibits essentially no exchange of uncoordinated and coordinated ligands for at least 1 minute.

In another embodiment of this invention, a method of forming images is provided which comprises:

1. conducting on a catalytic surface an imagewise oxidation-reduction reaction between an oxidizing agent and a reducing agent, the oxidizing agent being an inert (as described herein) metal complex, and
2. forming an image by chemically combining at least one of the reaction products of the oxidation-reduction reaction with a reactive species to produce a change in light value.

In still another embodiment of this invention, an improvement is provided in a method of forming images in which the ability of an active species to form a change in light value is inhibited imagewise by interaction with a reactant, which improvement comprises forming the reactant as the product of an imagewise oxidation-reduction reaction at a catalytic surface, the reaction products of the oxidation-reduction reaction being noncatalytic for the oxidation-reduction reaction.

In a further embodiment of this invention, an improvement is provided in a method of forming photographic images wherein an aromatic primary amino color-developing agent is oxidized in the development of an exposed photographic silver halide emulsion, and the oxidized color-developing agent reacts with a photographic color coupler to form a dye, which improvement comprises conducting the development in the presence of an oxidizing agent which is so chosen that, under the conditions of the photographic development, it undergoes redox reaction with the color-developing agent essentially only in the presence of metallic silver.

In another embodiment of this invention, the combination of an aromatic primary amino color-developing agent and an oxidizing agent in accordance with this invention is catalyzed into redox reaction by a metallic silver image, and the oxidized color-developing agent is reacted with a photographic color coupler to form a dye. The dye so formed can be transferred to a suitable receiving sheet, or it can supplement or replace the metallic silver image. Dye formation can take place in a photographic element comprising a colloid layer containing a silver image coated on a suitable support. The photographic color coupler can be incorporated in the colloid layer or a colloid layer contiguous to the colloid layer containing the silver image, or the coupler can be introduced separately, e.g., with the color-developing agent and oxidizing agent.

In another embodiment of this invention, an oxidizing agent-reducing agent combination in accordance with this invention enters into an imagewise redox reaction by contacting a metallic silver image, and the reduced form of the oxidizing agent is reacted with a reactive species to form a colored compound. The reactive species can be the oxidized form of certain reducing agents or a component which does not take part directly in the redox reaction.

In another embodiment of this invention, direct-positive emulsions are provided which comprise an oxidizing agent as described herein. The addition of many of the preferred oxidizing agents of this invention to conventional, negative developing-out silver halide emulsions results in substantial desensitization. This problem of desensitization is not evident when the oxidants are added to direct-positive silver halide emulsions.

In a further embodiment of this invention, a photographic film unit is provided comprising:

1. a photosensitive element comprising a support having thereon at least one photosensitive silver halide emulsion layer, each said silver halide emulsion layer having associated therewith a nondiffusible dye image-providing material capable of reacting with oxidized developing agent to produce a diffusible dye;
2. a support (which can be the same support used for the photosensitive silver halide emulsion layer) having thereon an image-receiving layer; and
3. a rupturable container containing an alkaline processing composition;

said film unit containing an aromatic primary amino color-developing agent and an oxidant in accordance with this invention which undergoes imagewise redox reaction with said developing agent in areas where metallic silver develops. The exposed photosensitive element is processed by contacting it with the developing agent and oxidant to form diffusible dye and diffusing the dye to the image-receiving layer. In one useful aspect of this embodiment of the invention, the photosensitive element comprises a support having coated thereon, in sequence, an image-receiving layer, an alkaline solution-permeable, substantially opaque, light-reflective layer, and the photosensitive layer thereover; the rupturable container is adapted to be positioned between the photosensitive element, after exposure thereof, and a process sheet adapted to be superposed over the outermost layer of the photosensitive support, so that a compressive force applied to the container will effect a discharge of the contents of the container between the process sheet and the outermost layer of the photosensitive element. The photosensitive portion of the photosensitive element preferably comprises a red-sensitive silver halide emulsion layer having associated therewith a cyan dye image-providing material comprising a nondiffusible coupler capable of reacting with oxidized aromatic primary amino color-developing agent to produce a diffusible cyan dye, a green-sensitive silver halide emulsion layer having associated therewith a magenta dye image-providing material comprising a nondiffusible coupler capable of reacting with oxidized aromatic primary amino color-developing agent to produce a diffusible magenta dye, and a blue-sensitive silver halide emulsion layer having associated therewith a yellow dye image-providing material comprising a nondiffusible coupler capable of reacting with oxidized aromatic primary amino color-developing agent to produce a diffusible yellow dye. The oxidant can be present in the receiving layer, the photosensitive element, the alkaline processing composition in the rupturable container, or in a solution in a second rupturable container when the pH of the alkaline processing solution is so high that it decomposes the particular oxidant selected.

In still another embodiment of this invention, processing compositions are provided comprising the oxidation-reduction combination featured in this invention.

The accompanying Figures are included for a further understanding of the invention. In the Figures, which are explained more fully below, log exposure is plotted on the abscissa and density on the ordinate.

In accordance with certain embodiments of this invention, a redox reaction between an oxidizing agent and a reducing agent is utilized to produce a change in light value. This change in light value can come about directly by a change in the light value of either the oxidizing agent or reducing agent. Alternatively, the redox reaction can result in one or more reaction products which can react with each other or with another component, such as a reactive species, to produce a change in light value. In another variation of the invention, the reactivity of the reactive species can be reduced imagewise.

Oxidants preferred in the practice of this invention are the metal complexes, such as a transition metal complex, e.g., a Group VIII metal complex, or a complex of a metal of Series 4 of the periodic table appearing on pp. 54–55 of Lange's *Handbook of Chemistry*, 8th Edition, published by Handbook Publisher, Inc., Sandusky, Ohio, 1952. Such complexes feature a molecule having a metallic atom or ion. This metallic atom or ion is surrounded by a group of atoms, ions or other molecules which are generically referred to as ligands. The metallic atom or ion in the center of these complexes is a Lewis acid; the ligands are Lewis bases. Werner complexes are well-known examples of such complexes. The useful metal salts are typically capable of existing in at least two valent states. In a preferred aspect of the invention, the metal complexes are those referred to by American chemists as "inert" and by European chemists as "robust". Particularly useful are complexes of a metal ion with a ligand which, when a test sample thereof is dissolved at 0.1 molar concentration at 20° C. in an inert solvent solution also containing 0.1 molar concentration of a tagged ligand of the same species which is uncoordinated, exhibits essentially no exchange of uncoordinated and coordinated ligands for at least 1 min., and preferably for at least several hours, such as up to 5 hr. or more. This test is advantageously conducted under the pH conditions which will be utilized in the practice of the invention. In silver halide photography, this generally will be a pH of over about 8. Many metal complexes useful in this invention show essentially no exchange of uncoordinated and coordinated ligands for several days. The definition of inert metal complexes and the method of measuring ligand exchange using radioactive isotopes to tag ligands are wellknown in the art; see, for example, Taube, *Chem. Rev.*, Vol. 50, p. 69 (1952), and Basolo and Pearson, *Mechanisms of Inorganic Reactions, A Study of Metal Complexes and Solutions*, 2nd Edition, 1967, published by John Wiley and Sons, p. 141. Further details on measurement of ligand exchange appear in articles by Adamson et al., *J. Am. Chem. Soc.*, Vol. 73, p. 4789 (1951). The inert metal complexes should be contrasted with labile complexes which, when tested by the method described above, have a reaction half-life generally less than 1 min. Metal chelates are a special type of metal complex in which the same ligand (or molecule) is attached to the central metal ion at two or more different points. The metal chelates generally exhibit somewhat slower ligand exchange than nonchelated complexes. Labile-type chelates may have a half-life of several seconds, or perhaps slightly longer. Generally, the oxidizing agents employed are not reduced to a zero valent metal during the redox reaction of the invention.

Preferred metal complexes in accordance with this invention have coordination numbers of 6 and are known as octahedral complexes. Cobalt complexes are especially useful in the practice of this invention. Most square planar complexes (which have a coordination number of 4) are rather labile, although some Group VIII metal square planar complexes, particularly platinum and palladium square planar complexes, exhibit inertness to rapid ligand exchange.

A wide variety of ligands can be used with a metal ion to form suitable metal complexes. Nearly all Lewis bases (i.e., substances having an unshared pair of electrons) can be ligands in metal complexes. Some typical useful ligands include the halides, e.g., chloride, bromide, fluoride, nitrite, water, amino, etc., as well as such common ligands as those referred to on p. 44 of Basolo et al., supra. The lability of the ligands in a complex is influenced by the nature of the ligands selected in forming said complex.

Particularly useful cobalt complexes have a coordination number of 6 and have a ligand selected from the group consisting of ethylenediamine(en), diethylenetriamine(dien), triethylenetetraamine(trien), amine ($NH_3$), nitrate, nitrite, azide, chloride, thiocyanate, isothiocyanate, water, carbonate and propylenediamine(tn). The preferred cobalt complexes comprise (a) at least two ethylenediamine ligands or (b) at least five amine ligands or (c) one triethylenetetraamine ligand or (d) at least two propylenediamine ligands. Especially useful are the cobalt hexamine salts (e.g., the chloride, bromide, sulfite, sulfate, perchlorate, nitrite and acetate salts). Some other specific highly useful cobalt complexes include those having one of the following formulas: $[Co(NH_3)_5H_2O]X$; $[Co(NH_3)_5CO_3]X$; $[CO(NH_3)_5Cl]X$; $[Co(NH_3)_4CO_3]X$; $[Co(en)_3]X$; cis-$[Co(en)_2(N_3)_2]X$; trans-$[Co(en)_2Cl(NCS)]X$; trans-$[Co(en)_2(N_3)_2]X$; cis-$[Co(en)_2(NH_3)N_3]X$; cis-$[Co(en)_2Cl_2]X$; trans-$[Co(en)_2Cl_2]X$; $[Co(en)_2(SCN)_2]X$; $[Co(en)_2(NCS)_2]X$; $[Co(tn)_3]X$; $[Co(tn)_2(en)]X$; and $[Co(tn)(en)_2]X$; wherein X represents one or more anions determined by the charge neutralization rule. Complexes containing oxidized noble metals or ferromagnetic metals, such as complexes of $Cr^{III}$, $Fe^{III}$, $Rh^{III}$, $Pt^{IV}$, $Pd^{IV}$ and $Ir^{III}$; which have reactivities similar to the complexes listed above, could be used in the practice of this invention. The redox equilibra published in *Stability Constants of Metal-Ion Complexes*, Sillen and Martell, published by The Chemical Society, Burlington House, London, England (1964), indicate that other complexes have reactivities generally similar to the cobalt complexes mentioned above.

With many complexes, such as cobalt hexammine, the uncoordinated anions selected can substantially effect the reducibility of the complex. The following anions are listed in the order of those which give increasing stability to cobalt hexammine complexes: bromide, chloride, nitrite, perchlorate, acetate, carbonate, sulfite and sulfate. Other ions will also effect the reducibility of the complex. These uncoordinated anions should, therefore, be chosed to provide complexes exhibiting the desired degree of reducibility. Some other uncoordinated anions include hydrochloride, nitrate, thiocyanate, dithionate and hydroxide. Neutral complexes such as $[Co(dien)(SCN)_2OH]$, are useful, but positively charged complexes are generally preferred.

A theory has been advanced to explain the low reactivity between the reducing agent and the central metal ion of the metal complex. It appears that the ligands constitute an effective barrier to reaction between reducing agents and the central metal ion. The barrier may be set up by ligands tightly bound to and surrounding the central metal ion. In the presence of certain catalysts, it seems that one or more of the ligands may be bound less tightly to the central metal ion, thus facilitating reaction between the central metal ion and the reducing agent. However, this invention is not limited to that theory.

In certain highly preferred embodiments, the cobalt-(III) ion complexes used in this invention have a net positive charge which is preferably a net charge of +2. A cobalt(III) ion with six $(NH_3)$ ligands has a net charge of +3. A cobalt (III) ion with five $(NH_3)$ ligands and one chloro ligand has a net charge of +2. A cobalt-(III) ion with two ethylenediamine(en) ligands and two $(N_3)$ azide ligands has a net charge of +1. In certain embodiments, the best results occur where the cobalt-(III) complex has a net charge of +3 and/or the cobalt complex contains at least three ammine ligands.

Numerous reducing agents can be utilized in carrying out the present invention. The reducing agents utilized herein undergo redox reaction with the oxidizing agent at a catalytic surface. Especially preferred reducing agents are those which reduce silver halide to metallic silver, such as those which are capable of developing imagewise-exposed, light-sensitive photographic silver halide. Depending upon the particular oxidizing agent utilized, the reducing agent can be selected from such reducing agents as hydroquinones, catechols, aminophenols, 3-pyrazolidones such as 1-phenyl-3-pyrazolidone, 1-, d- or isoascorbic acid, reductones and phenylenediamines. Dye developers, such as those described and referred to in Rogers, U.S. Pat. No. 2,983,606 issued May 9, 1961, are also reducing agents which are preferably used in combination with an auxiliary developing agent. In certain aspects of the invention, the reducing agent is an aromatic primary amine color-developing agent such as p-aminophenol (which forms particularly stable redox combinations with certain complexes, e.g., $[Co(en)_3]Cl_3$ or p-phenylenediamines. Typical color-developing agents include 3-acetamido-4-amino-N,N-diethylaniline, p-amino-N-ethyl-N-($\beta$-hydroxyethyl)aniline sulfate, p-aminoethyl-$\beta$-hydroxyaniline, N,N-diethyl-p-phenylenediamine, 2-amino-5-diethylaminotoluene, N-ethyl-N-($\beta$-methanesulfonamidoethyl)-3-methyl-4-aminoaniline, 4-amino-N-ethyl-3-methyl-N-($\beta$-sulfoethyl)aniline, 4-amino-N-ethyl-N-(2-methoxyethyl)-m-toluidine di-p-toluene sulfonate, 4-amino-N-butyl-N-)-sulfobutylaniline, 4-amino-N,N-diethyl-3-n-propylaniline hydrochloride, and the like. See Bent et al., *JACS*, Vol. 73, pp. 3100–3125 (1951), and Mees and James, *The Theory of the Photographic Process*, 3rd Edition, 1966, published by MacMillan Co., New York, pp. 278–311, for further typical, useful developing agents. Other reducing agents which are silver halide developers are also useful in the practice of this invention, such as the alkali metal borohydriedes, amine boranes (preferably trimethylamine borane), polyamine boranes, phosphine boranes, arsine boranes, stilbene boranes and borazines, such as those described in columns 3 and 4 of Perkins et al., U.S. Pat. No. 3,266,895 issued Aug. 16, 1966. It will be appreciated that many of the subject reducing agents are most effective at high pH, such as a pH from about 8 to 13.

I have also found that some compounds which are not ordinarily good silver halide developers can be used in combination with inert transition metal complexes, and especially cobalt complexes, to provide good silver halide development. Hydroquinone sulfonate, p-benzoquinone, sodium dithionite and the like can be used in combination with transition metal complexes to develop silver halide emulsions. Where sodium dithionite is used as the developer, a fixing agent is produced as a function of development which in turn can be used in subsequent steps of processing.

The redox reaction which takes place in the practice of this invention occurs at a catalytic surface; i.e., the reaction environment is a heterogeneous medium wherein the catalyst is in one phase, the oxidant and reductant are in another phase, and the reaction takes place on the interface between the phases. Generally, the catalyst will be a solid material and the oxidant and the reductant will be in a liquid phase. Any catalytic material can be utilized which initiates and promotes redox reaction between the oxidizing agents and reducing agents selected. While the reaction mechanism is not completely understood, it appears that the catalyst appears to allow electron transfer between the oxidizing agent and the reducing agent. In a preferred embodiment, the catalysts are the metals or the chalcogens of Group VIII or IB elements. In another embodiment, the catalyst can be activated carbon or activated charcoal. Many useful catalysts are the zero valent metals or metal nuclei. Specific useful catalysts include metals such as platinum, copper, silver, gold and chalcogens such as silver sulfides, silver oxides, nickel sulfide, cuprous sulfide, cobalt sulfide, aurous sulfide and cupric oxide. While several of the catalysts are referred to as chalcogens, it is understood that, in some instances, an equilibrium mixture may be present in the product, such as a mixture of silver hydroxide and silver oxide.

In accordance with this invention, the catalyst appears to provide redox reaction in a true catalytic fashion. The amount of redox reaction is not limited by the amount of catalyst present, since the redox reaction of this invention does not proceed on a stoichiometric basis with respect to the catalyst. Generally, in the absence of the catalyst the oxidant and the reductant can be described as being in a state where they are substantially kinetically stable; i.e., the kinetic reaction is so slow or practically nonexistent as to be not noticeable in the process. The catalyst appears to interact with the oxidant and/or reductant in such a fashion as to overcome the kinetic barrier. Where the oxidant and reductant are thermodynamically stable in the reaction medium, the catalyst can lower the kinetic barrier by converting either the oxidant or reductant to another form which will provide a thermodynamically unstable combination which is also kinetically unstable. Where the oxidant and reductant are thermodynamically unstable but substantially kinetically stable, the catalyst can function to lower the kinetic barrier, allowing the reaction to proceed at a substantially faster rate.

In one aspect of this invention, an imagewise pattern of catalyst is employed. Any means can be utilized for obtaining the imagewise pattern of catalyst including photoreduction (e.g., the photoreduction of a silver salt such as a silver halide salt to metallic silver, the photoreduction of a palladium salt such as palladium oxalate to metallic palladium, or the photoreduction of a gold salt such as a gold halide salt to metallic gold); photooxidation (e.g., metallic silver to $Ag^+$); the photolytic formation of a suitable inhibitor, such as phenylmercaptotetrazole, which can be released imagewise from compounds such as those described in Barr et al., U.S. Pat. No. 3,227,554 issued Jan. 4, 1966; electrostatic deposition of a catalyst on a latent image, such as charged particles of carbon or a zero valent metal; the chemical deposition of a catalyst on a latent image, such as the deposition of zero valent metal such as silver or gold, on exposed titanium dioxide or zinc oxide; or mechanical deposition of the catalyst. Various means which can be used to generate catalysts or catalyst precursors include those described and referred to in British Patent No. 1,194,581 issued June 10, 1970, and Hillson and Ridgway, Belgian Patent No. 750,182 of July 15, 1970.

Some care is needed in selecting the particular oxidant-reductant-catalyst combination employed in the practice of the invention, bearing in mind the circumstances governing any particular embodiment of the invention. The oxidizing-reducing agent combination should undergo essentially no redox reaction except in the presence of external catalyst material. Also, the catalyst should be so selected that it is essentially unreactive under the conditions employed with either the oxidizing agent alone or reducing agent alone. In the environment in which the reaction takes place, the catalyst should promote the redox reaction but should not itself undergo a redox reaction directly with either the reducing agent or oxidizing agent to any substantial degree; i.e., they should be substantially kinetically stable. Preferably, the oxidizing agent and the reducing agent are so chosen that, when test samples thereof are each dissolved at a 0.01 molar concentration in an inert solvent at 20° C., essentially no redox reaction occurs for at least 15 min. and preferably for several hours, such as 12 hr., or several days, such as a month or more.

Combinations of oxidant and reductant which undergo a more rapid redox reaction in the absence of catalyst are, however, useful in embodiments of the invention where the oxidizing agent and reducing agent are in reactive condition for brief periods of time. In one such embodiment, separate solutions of oxidizing agent and reducing agent can be sprayed on a support carrying an imagewise distribution of catalyst. An imagewise redox reaction takes place in the presence of the catalyst. After sufficient redox reaction occurs, the unreacted reducing agent and oxidizing agent are removed in any convenient manner, for example, using an air jet, a stream of liquid or a chemical neutralizer. In other embodiments of the invention, an imagewise pattern of catalyst, together with a nonimagewise distribution of oxidant (or reductant), can be contacted with reductant (or oxidant) for a time sufficient to permit imagewise redox reaction. Thereafter, the reductant (or oxidant) can be removed. In these and other embodiments of the invention, the oxidant and reductant need not possess a high degree of inertness to redox reaction in the absence of catalyst.

In preferred embodiments of the invention, an imagewise pattern of catalyst is contacted with the combination of oxidizing and reducing agent in accordance with the invention. However, a nonimagewise distribution of oxidizing agent and catalyst can be contacted with an imagewise pattern of reducing agent, or an imagewise pattern of oxidizing agent can be contacted with the combination of reducing agent and catalyst, to form images in accordance with the invention. Also, an imagewise pattern of catalyst, together with a nonimagewise distribution of oxidizing agent, can be contacted with reducing agent or an imagewise pattern of catalyst, together with a nonimagewise distribution of reducing agent, can be contacted with oxidizing agent to initiate redox reaction in accordance with the invention.

Any suitable means can be utilized to contact the oxidizing agent, reducing agent and catalyst. For example, an imagewise pattern of catalyst can be contacted with a solution containing oxidant and reductant. In one convenient embodiment of the invention, a hydrophilic colloid layer, coated on a suitable support, contains a pattern of catalyst and is contacted with an aqueous solution containing oxidant and reductant. The concentration of reductant and oxidant in such solutions can vary over a wide range. Optimum concentrations depend on such variables as time of contact, amount of catalyst present, and reactivity of the particular oxidizing agent-reducing agent-catalyst combination chosen. Typical useful concentrations of oxidant and reductant, each, range from about 0.1 to 50, and preferably 1 to 15, g./liter of solution, using contact or residence times of about 30 sec. up to 2 hr. or longer.

The oxidizing agent and reducing agent can also be contained in and released from rupturable pods or pressure-sensitive capsules. An alternative method for initiating redox reaction in accordance with the invention involves incorporating the oxidant and reductant in a hydrophilic colloid layer, coated on a suitable support, and contacting the layer with a plate bearing a metal catalyst relief image. The metal relief image initiates and promotes the redox reaction between the oxidant and reductant contained in the hydrophilic colloid layer. If desired. portions of the oxidant or reductant can be incorporated both in processing solutions and hydrophilic colloid layers, which can also contain a suitable source of catalyst, such as light-sensitive silver halide.

Where the oxidant and reductant for the redox reaction are present in a processing solution, agitation of the solution is often desirable to assure that wide concentration variances do not occur at the surface of the photographic element. In certain instances, gases such as nitrogen can be bubbled through the solution to provide agitation. In certain embodiments, and especially where image dye-providing reaction takes place, it has been found that oxygen bubbled through the solutions before and/or during processing provides increases in the maximum dye density obtained in the photographic element without corresponding increases in Dmin.

The reducing agent and the oxidizing agent employed herein advantageously have good solubility in water; preferably, they are soluble in amounts of at least 0.1 g. and preferably at least 10 g./liter of water. However, other solvents, preferably polar solvents such as methanol or ethanol, can be employed. In certain embodiments of the invention, reducing agents and oxidizing agents having very low water solubility can be employed.

The processes of the invention are admirably suited to amplify faint or even invisible quantities of catalyst. The invention is highly effective with light-sensitive silver halide materials wherein latent image silver or a low-density silver image can be utilized to generate a visible image. In addition, the processes of the invention are useful in supplementing an image, for example, a silver or other zero valent metal image or an image composed of other catalysts, oxidants or reductants utilized in accordance with the invention. It is also possible to replace preformed images with other images in accordance with the processes of the invention.

In one preferred method of forming images in accordance with the invention, at least one of the reaction products of the redox reaction is reacted with a further component or reactive species to produce a change in light value. In a particularly useful embodiment of the invention, the reducing agent forms an oxidizing species which reacts, or couples, with certain compounds, known in the art as photographic color couplers, to form image dyes.

In another aspect of the invention, the oxidizing agent by the redox reaction is reduced to a species which produces a change in light value by interaction with a reactive species, such as an 8-hydroxyquinoline, a formazan dye, a 2,4-diaminophenol, an $\alpha$-nitroso-$\beta$-naphthol or 1-(2′,4′,6′-trichlorophenyl)-3-[3″-(2‴,-4‴-di-tert-amylphenoxyacetamido)benzamido]5-pyrazolone. Compounds such as 8-hydroxyquinoline are useful in this embodiment of the invention even when the coupling position is blocked. For example, 8-hydroxy-5,7-dimethylquinoline can be employed, although both coupling positions are blocked.

In still another aspect of the invention, one of the reaction products of the redox reaction featured in this invention is utilized to decrease the reactivity, or "poison", image-forming components or reactive species.

In another aspect of this invention, an improvement is provided in photographic processes wherein imagewise-exposed photographic elements comprising a support having coated thereon silver halide grains dispersed in a crosslinkable colloid are developed to produce a silver image, and the colloid can be crosslinked imagewise in areas where a metallic silver develops to amplify the image record. This is effected by contacting such photographic elements with the combination of an oxidant and reductant which undergo imagewise redox reaction in the presence of metallic silver, the reduced form of said oxidant being a crosslinking agent for the colloid. The process of this aspect of the invention can be conducted with a photographic developer as reducing agent. The oxidized form of the developoping agent can also function as a crosslinking agent. The metallic silver produced by the action of a photographic developer on exposed silver halide catalyzes an oxidation-reduction reaction to continue generating crosslinking agent as long as the redox reaction continues.

If desired, subsequent to developing a silver image in a crosslinkable colloid, the photographic element is contacted with the combination of oxidizing agent and reducing agent in accordance with the invention to generate the crosslinking agent. Using the latter procedure, it is not necessary that the reducing agent be a selective photographic silver halide developing agent. When metal complexes are employed as oxidants, it is preferable that the ligands released on redox reaction should not interfere with the crosslinking.

This invention is useful in conventional tanning development where any suitable colloid, preferably gelatin, is crosslinked or hardened. Advantageously, the silver halide emulsion is an unhardened or partially hardened gelatin silver halide emulsion.

The practice of this aspect of the invention results in tanning with developers which have not been considered tanning developers in the prior art, and increases the tanning obtained with conventional tanning developers. The invention is, accordingly, useful with any of the known tanning developing agents, e.g., pyrogallol and catechols such as 4-phenylpyrocatechol, or photographic developing agents which normally tan or crosslink colloids, such as the hydroquinones, pyrazolidones such as 1-phenyl-3-pyrazolidone, the p-phenylenediamines, the p-aminophenols and the diaminophenols. This embodiment of the invention is useful in dye imbibition and colloid transfer processes and in the preparation of photoresists, planographic printing plates and lithographic printing plates.

This invention permits the incorporation of substantial amounts of sulfite (e.g., sodium sulfite) in the tanning developer solutions, while retaining effective tanning. The amount of sulfite which could be added to conventional tanning developing agents was limited because of the inhibiting effect sulfite has on tanning development. Hence, using the practice of this invention, more stable tanning developer solutions are possible because of the higher tolerance for sulfite stabilizer in accordance with this invention.

In certain embodiments of the invention, the products of the redox reaction (i.e., the oxidized reducing agent and the reduced oxidizing agent) are capable of undergoing reaction with a particular reactive species. For certain purposes it may be desirable to prevent one of the reaction products of the redox reaction from undergoing any substantial reaction with the reactive species. This objective can be readily accomplished by employing a "blocking" reactant, which prevents undesired interaction with the reactive species. An example of such a system is a redox combination comprising a cobalt(III) complex oxidizing agent, photographic aromatic primary amino color-developing agent as reducing agent, metallic silver as catalyst, and photographic color coupler as the reactive species. In the presence of the silver catalyst, the cobalt(III) is reduced to cobalt(II) and the developing agent is oxidized. Both the cobalt(II) and the oxidizing developing agent are capable of reacting with many photographic color couplers to produce a change in light value. When the only desired change in light value is the reaction product of the oxidized developing agent and photographic color coupler, the blocking reactant is utilized to prevent interaction between the reduced oxidizing agent (in this instance, cobalt(II) and the photographic color coupler. Any suitable blocking agent can be utilized, such as a chelating agent, e.g., ethylenediaminetetraacetic acid, sodium hexametaphosphate, sodium tetraphosphate or 2-hydroxypropylenediaminetetraacetic acid, when it is desired to inhibit the reactivity of the cobalt(II). Other appropriate blocking agents can be selected by the art-skilled for selectively controlling the reactivity of one or more of the reaction products of the redox reaction.

As used herein, the phrase "change in light value" means instances wherein a colored reactive species undergoes a change in color or becomes colorless, as well as instances wherein a colorless reactive species becomes colored.

This invention is particularly useful in processing photographic elements utilized in a subtractive multicolor photographic system wherein the emulsion layers contain, or have contiguous the silver halide thereof, photographic color couplers. As used herein, the term "photographic color couplers" includes any compound which reacts (or couples) with the oxidation products of primary aromatic amino developing agent on photographic development to form a dye, and are nondiffusible in a hydrophilic binder (e.g., gelatin) useful for photographic silver halide. Typical useful color formers include phenolic, 5-pyrazolone and open-chain ketomethylene compounds. Specific cyan, magenta and yellow color formers which can be used, respectively, in the cyan, magenta and yellow dye-forming units of the invention are described in Graham et al., U.S. Pat. No. 3,046,129 issued July 24, 1962, column 15, line 45, through column 18, line 51. Such color formers can be dispersed in the emulsion layers in any convenient manner, such as by using the solvents and the techniques described in U.S. Pat. Nos. 2,322,027 or 2,801,171. The useful couplers include Fischer-type incorporated couplers such as those disclosed in Fischer, U.S. Pat. No. 1,055,155, and particularly nondiffusible Fischer-type couplers containing branched carbon chains, e.g., those referred to in the references cited in Frohlich et al, U.S. Pat. No. 2,376,679, column 2, lines 50–60. These elements can be processed by one of the procedures described in Graham et al., U.S. Pat. No. 3,046,129, columns 23 and 24. and using an oxidizing agent-reducing agent combination as described herein.

This invention is useful in subtractive multicolor photographic processes wherein color former is introduced into the silver halide emulsion layers during development. Processes of this type are described in the literature, such as Mannes et al., U.S. Pat. No. 2,252,718 issued Aug. 19, 1941. Typical useful color formers which can be used in such processes include the aqueous alkali-soluble pyrazolone, phenolic and open-chain ketomethylene photographic color couplers which combine with the reaction products of color-developing agents, such as p-phenylenediamine, to form magenta, cyan and yellow dyes. Specific color formers which can be used include those cited in U.S. Pat. No. 3,165,407 by McCarthy issued Jan. 12, 1965, column 2, line 20, through column 3, line 47; U.S. Pat. No. 2,801,171 by Fierke et al. issued July 30, 1957; and U.S. Pat. No. 2,875,057 by McCrossen et al. issued Feb. 24, 1959.

In color systems of the type described above, subtractive dye images can be generated by a color negative process, such as the process described by W. T. Hanson and W. I. Kesner in an article in the *Journal of the Society of Motion Picture and Television Engineers*, Vol. 61 (1953), pp. 667–701, or by a color reversal process wherein reversal silver images are generated in any convenient manner, such as by using a direct-positive emulsion or using a negative emulsion which is given an imagewise exposure, developed in a black-and-white developer to provide a negative silver image, and then given at least one additional exposure (or other suitable fogging treatment) followed by additional development to generate the desired subtractively colored dye images.

The color-forming developers which can be used in accordance with the two processes described above have been previously described in the art. The most useful of such color forming developers are the phenylenediamines and substituted derivatives thereof, such as those disclosed in U.S. Pat. No. 2,548,574 by Weissberger et al. issued Apr. 10, 1951; U.S. Pat. No. 2,552,240–2 by Weissberger et al. issued May 8, 1951, and U.S. Pat. No. 2,566,271 by Weissberger et al. issued Aug. 28, 1951. Other phenylenediamine color-forming developers can be employed to advantage in the process of this invention.

This invention is also applicable to other photographic processes for forming multicolor images, such as color diffusion transfer processes of the type described in U.S. Pat. No. 2,983,606 by Rogers issued May 9, 1961; U.S. Pat. No. 3,146,102 by Weyerts issued Aug. 25, 1964; U.S. Pat. No. 3,087,817 by Rogers issued Apr. 30, 1963; U.S. Pat. No. 3,227,551 by Barr et al. issued Jan. 4, 1966; U.S. Pat. No. 3,227,554 by Barr et al. issued Jan. 4, 1966; U.S. Pat. No. 3,243,294 by Barr issued Mar. 29, 1966; U.S. Pat. No. 2,337,550 by Whitmore et al. issued Jan. 4, 1966; U.S. Pat. No. 2,756,142 by Yutzy issued July 24, 1956; U.S. Pat. No. 3,227,552 by Whitmore issued Aug. 27, 1964; U.S. Pat. No. 3,765,886 by Bush et al. issued Oct. 16, 1973; U.S. Pat. No. 3,443,940 by Bloom et al. and U.S. Pat. No. 3,443,943 by Rogers, both issued May 13, 1969, and U.S. Pat. No. 3,415,644–6 by Land issued Dec. 10, 1968. The process of this invention is useful in generating diffusible dye images by the method described by Fleckenstein et al. in U.S. Ser. No. 176,751 filed Aug. 8, 1971, now abandoned. An oxidant in accordance with the present invention, such as a cobalt complex, e.g., cobalt hexammine(III) chloride, is present during development. The developer (which can be a black-and-white developing agent or a color-developing agent) undergoes a redox reaction with the oxidant, and the resulting oxidized form of the reducing agent crossoxidizes with a nondiffusible compound (e.g., a p-sulfonamidoaniline or a p-sulfonamidophenol) which, upon oxidation, releases a diffusible color-providing moiety.

The processes of this invention are useful in color diffusion transfer systems, such as those wherein the dye-receiving sheet is separated from the photosensitive element after processing, such as the elements described in U.S. Pat. No. 3,362,819, and color diffusion transfer systems wherein the film unit and the dye image-receiving layer are integral, as described in U.S. Ser. Nos. 115,459 by Barr et al. and 115,552 by Cole, both filed Feb. 16, 1971, and now abandoned. The present invention allows the use of thinner layers in the photo-sensitive elements, thus requiring a smaller amount of processing composition. The processing composition accordingly can contain less solvent, which reduces problems associated with evaporating solvent after processing the photographic elements. When opacifying agents are employed, they are preferably chosen so that they are not catalysts for a redox reaction as described herein, if such reaction would tend to degrade the quality of the image.

Advantageously, the photographic color couplers utilized are selected so that they will give a good neutral. Preferably, the cyan dye formed has its major absorption between about 600 and 680 nm., the magenta dye has its major absorption between about 500 and 580 nm., and the yellow dye has its major absorption between about 400 and 480 nm.

This invention is useful in developing any of the exposed light-sensitive silver halides including silver bromide, silver iodide, silver chloride or mixed silver halides such as silver chlorobromide, silver bromoiodide or silver chlorobromoiodide. The invention is useful in developing negative emulsions, as well as emulsions in which the silver halide grains have high internal sensitivity, or fogged direct-positive emulsions such as those described in U.S. Pat. No. 2,497,875 by Falleson issued Feb. 21, 1950; U.S. Pat. No. 2,563,785 by Ives issued Aug. 7, 1951; U.S. Pat. No. 3,501,305–7 by Illingsworth issued Mar. 17, 1970; U.S. Pat. No. 3,690,891 by Spence et al. issued Sept. 12, 1972; U.S. Pat. No. 3,687,679 by Spence et al. issued Aug. 29, 1972, and U.S. Pat. No. 3,761,276 by Evans issued Sept. 25, 1973, and Belgian Patent No. 770,293 of Aug. 31, 1971. Other light-sensitive materials which form catalysts can also be utilized. A particularly useful class of light-sensitive catalyst-producing materials are the silver spectral-sensitizing dye complexes described in Gilman et al., U.S. Pat. No. 3,446,619 issued May 27, 1969. The most useful species of such light-sensitive materials are the reaction product of silver ion with a cyanine, merocyanine, oxonol, hemioxonol, hemicyanine, styryl or benzylidene dye.

This invention is useful in processing light-sensitive silver halide emulsion which contain various chemical sensitizers, optical sensitizers, stabilizers, speed-increasing compounds, plasticizers, hardeners and coating aids, such as are described and referred to in Beavers, U.S. Pat. No. 3,039,873 issued June 19, 1962, columns 9–12. The light-sensitive silver halide salts can be dispersed in various binders, such as the colloids described and referred to in the aforementioned Beavers patent, column 13, and the like. Any suitable support can be used, such as a cellulose ester, poly(ethylene terephthalate) paper, baryta-coated paper, or polyolefin-coated paper such as polyethylene- or polypropylene-coated paper, which can be treated with a corona discharge to promote emulsion adhesion. Emulsion layers having different speeds can be utilized to extend the latitude of the element.

The following examples are included for a further understanding of the invention. Examples 1 to 4 show that a preformed photographic silver image is useful to catalyze an oxidation-reduction reaction according to the present invention. The reducing agent (a photographic color developer) is oxidized in an imagewise pattern by the oxidizing agent and combines with a photographic color coupler to produce a dye image. The dye image intensifies the silver image or replaces the silver image if the silver is subsequently bleached.

Examples 1–4 also demonstrate that a variety of color developers are useful as the reducing agent of the present invention and that the oxidizing agent can be a complex cobalt salt having ligands selected from the group consisting of ammine, ethylenediamine(en), diethylenetriamine(dien), triethylenetetraamine(trien), azido, chloro, thiocyanato and isothiocyanato and anions selected from the group consisting of nitrate, chloride, bromide, perchlorate, thiocyanate and dithioante.

Examples 5 and 6 demonstrate that a latent image of silver specks can catalyze the oxidation-reduction reaction according to the present invention. The image of Example 5 is formed by a reaction of oxidized reducing agent (color developer) with a photographic dye-forming coupler. The image of Example 6 is formed by the reaction of reduced oxidizing agent (cobalt(II) ions) with the reactive compound, 8-hydroxyquinoline.

It is shown in Examples 7 and 8 that the process of the present invention is useful in the direct development of a color negative film. The process provides higher dye densities with a lower fog than the prior-art process.

In Example 9, an image-transfer process is shown wherein the reduced form of the oxidizing agent of this invention is used imagewise to prevent color coupling from occurring.

Example 10 shows the utility of the process of the present invention in developing a reversal color film. Examples 11–13 show the use of various catalytic image materials such as carbon and gold in the process of this invention, as well as various methods for preparing an imagewise distribution of the catalytic image material.

Example 14 discloses the use of the process of this invention with a predeveloped silver image to form a colored image in proportion to and of higher density than the initial silver image.

Example 15 shows that the addition of an oxidizing agent according to this invention, such as a cobalt complex salt, enhances the tanning effectiveness of known photographic tanning developers such as pyrogallol or pyrocatechol and makes useful tanning developers of photographic developers such as p-phenylenediamines, aminophenols and diaminophenols which have little or no tanning action when used alone.

Examples 17 and 18 show the advantages of higher maximum image density and greater relative speed when using the process of the invention compared with that known in the prior art.

Example 19 shows the formation of a dye image by coupling a diaminophenol silver halide developer with cobalt(II) ions from an oxidation-reduction reaction according to this invention. The dye image intensifies the silver image or replaces the silver image if the silver image is bleached.

EXAMPLE 1

A. A gelatin silver bromoiodide emulsion, prepared as described by Trivelli and Smith, *The Photographic Journal*, Vol. LXXIX, May, 1939, pp. 330 and 338, wherein the halide of said emulsion is about 2 mole percent iodide, is coated on a cellulose acetate film support at a coverage of about 100 mg. of silver and 300 mg. gelatin/ft.$^2$. The coating also contains 150 mg./ft.$^2$ of a cyan dye-forming coupler, 5-(α-(2,4-di-tert-amylphenoxy)hexaneamido]-2-hepta-fluorobutyramidophenol dissolved in 75 mg. of the coupler solvent dibutyl phthalate. This film is cut into 12 samples which are given identical exposures through a 0.3 neutral density step tablet in an intensity scale sensitometer, developed to a negative silver image for 2 min. at 24° C. in Kodak D-72 Developer (diluted 1:1 with water), fixed for 5 min., washed for 5 min. and dried. The sensitometric curves are read through a Status A Red Filter, which is a narrow-band optical filter comprising a Wratten 29 filter laminated to a 2-mm. thick plate of Corning Glass No. 9780. This filter transmits light of wavelengths between 600–700 nm. having peak transmittance at 630 nm. The silver image in each of the 12 samples is shown in FIG. 1, Curve A. The quantities of silver in Steps 2 and 9 of the sensitometric curve of one of the processed samples are analytically determined to be, respectively, 60 mg. and 35 mg./ft.$^2$ of coating.

B. Of the 12 samples, four are then treated at a temperature of 24° C (75° F.) in Processing Solution 1 (see composition below) for 2, 4, 8 and 16 min. respectively, followed by a 2-min. wash, a 5-min. fix, a 5-min. wash, and drying.

| Processing Solution 1 | |
|---|---|
| 4-amino-N-ethyl-N-β-hydroxyethylaniline sulfate (color-developing agent) | 20.0 g. |
| Phenidone (1-phenyl-3-pyrazolidone) 0.1 g. | |
| $Na_2SO_3$ | 40.0 g. |
| KBr | 0.5 g |
| EDTA (ethylenediaminetetraacetic acid) | 8.0 g. |
| water to make 1 liter | |
| pH adjusted with NaOH to 11.0 | |

The sensitometric curves of the images in the four samples (read through a Status A Red Filter as described above) are represented by Curve A, FIG 1. Note that this curve is a direct duplicate of the sensitometric curve obtained with the black-and-white development described above showing that no dye is formed by treating the initial silver image in Processing Solution 1, which does not contain an oxidizing agent-reducing agent combination according to the invention. The quantity of silver/ft.$^2$ of coating in Steps 2 and 9 is again analyzed and found to remain unchanged. All 4 curves are superimposable.

C. A second set of four of the 12 samples is processed by the same procedure as in (B), but with 2.5 g. of $[Co(NH_3)6]$-$Cl_3$ added to Processing Solution 1. The processing solution thus contains a reducing agent (i.e., the color-developing agent) and an oxidizing agent (i.e., the hexammine cobalt(III) chloride) combination of the invention. The quantity of silver in Steps 2 and 9 of each of the four samples is determined and remains unchanged. Characteristic curves of the silver-pulse-dye images in these four samples are not recorded, but a visual inspection of the samples indicates increased density with increased development time.

d. The remaining set of four samples of the 12 coatings is processed by the procedure according to (C) above, but the silver is bleached and subsequently removed from the coatings by fixing and washing. The processing after treatment in Processing Solution 1 consists of the steps:

| | |
|---|---|
| bleach | 5 min. |
| wash | 2 min. |
| fix | 5 min. |
| wash | 5 min. |
| dry | |

The samples now contain only the dye images (read through a Status A Red Filter as described above) which are represented by sensitometric curves B, C, D and E in FIG. 1. In this example, the preformed silver image catalytically initiates and promotes an oxidation-reduction reaction between the oxidizing agent (hexammine cobalt (III) chloride) and the reducing agent (the color-developing agent in this example).

Generally similar results are obtained when the color-developing agent 4-amino-N-ethyl-N-β-hydroxyethylaniline sulfate is replaced with any of the following photographic color developers: 4-amino-3,5-dimethoxy-N,N-diethylaniline, 4-amino-3-methyl-(N-ethyl-N-β-methanesulfonamidoethyl)aniline, 4amino-3methyl-(N-ethyl-N-β-methoxyethyl)aniline dibenzene sulfonate, 4-amino-N-ethyl-N-β-hydroxyethylaniline sulfate, 4-amino-3-methyl-N,N-diethylaniline, 4-amino-2,6-dibromophenol, 4-amino-3-methyl-N-ethyl-N-β-(methanesulfonamidoethyl)aniline, 4-amino-3-methyl-(N-ethyl-N-β-methoxyethyl)aniline-1,5-naphthalenedisulfonate, 2,4-diaminophenol, or 4-amino-3-methyl-(N-ethyl-N-β-hydroxyethyl)aniline p-toluenesulfonate.

Processing Solution 1 of Example 1 containing the reducing agent, 4-amino-N-ethyl-N-β-hydroxyethylaniline sulfate, and the oxidizing agent, hexammine cobalt(III) chloride, can be kept at room temperature for several hours or longer without appreciable deterioration. In contrast, the developing solution described in Belgian Patent No. 743,768 containing a peroxy compound an an aromatic amine color-developing agent decomposes in a very short time and must be mixed immediately before use.

EXAMPLE 2

Nine samples of film emulsion coatings are prepared, exposed, developed to a negative silver image, washed, fixed and dried as described in Example 1. Each of the nine samples is then treated for 16 min. at a temperature of 24° C. (75° F.) in Processing Solution 1 of Example 1, containing in each case 2.5 g., respectively, of the following oxidizing agents:

1. cis-$[Co(en)_2(N_3)_2]NO_3$
2. trans-$[Co(en)_2Cl(NCS)]NCS$
3. trans-$[Co(en)_2(N_3)_2]ClO_4$ 4. cis-$[Co(en)_2(NH_3)(N_3)]S_2O_6$
5. cis-$[Co(en)_2Cl_2]Cl$
6. trans-$[Co(en)_2Cl_2]Cl$
7. $[Co(en)_2(SCN)_2]Cl$
8. $[(Co(en)_2(NCS)_2]SCN$
9. $[Co(NH_3)6]Br_3$ Each sample is then treated at 24° C. (75° F.) in the following conventional color-processing steps:

| | |
|---|---|
| bleach | 5 min. |
| wash | 2 min. |
| fix | 5 min. |
| wash | 5 min. |
| dry | |

Each sample has essentially the same cyan dye image and sensitometric curve as Curve E in FIG. 1.

EXAMPLE 3

Example 1 is repeated except that the $[Co(NH_3)6]Cl_3$ is replaced by an equivalent amount of one of the following metal complex oxidizing agents: $[Co(en)_2(dien)]Cl_2.HCl$, $[Co(NH_3)_5\text{-}H_20)](ClO_4)_3$, $[Co(NO_2)_3(NH_3)_3]$, $[Co(NH_3)4(CO_3)]NO_3$, trans-$[Co(en)_2(Cl)_2]Cl.HCl$ trans-$[Co(en)_2(N_3)(NO_2)]S_2O_6$, $[Co(trien)\text{-}(NO_2)_2]NO_3{\cdot}H_2O$, cis-$[Co(trien)(Cl)_2]Cl$, $[Co(en)_2(NO_2)_2](ClO_4)_3$, $[Co(trien)(N_3)_2]NO_2$, $[Co(en)_2(NH_3)_2]Cl_3$, or $[Co(tn)_2(en)]Cl_3$.

With each of the oxidizing agents a useful but somewhat less dense cyan dye image is obtained.

EXAMPLE 4

Figure 2:
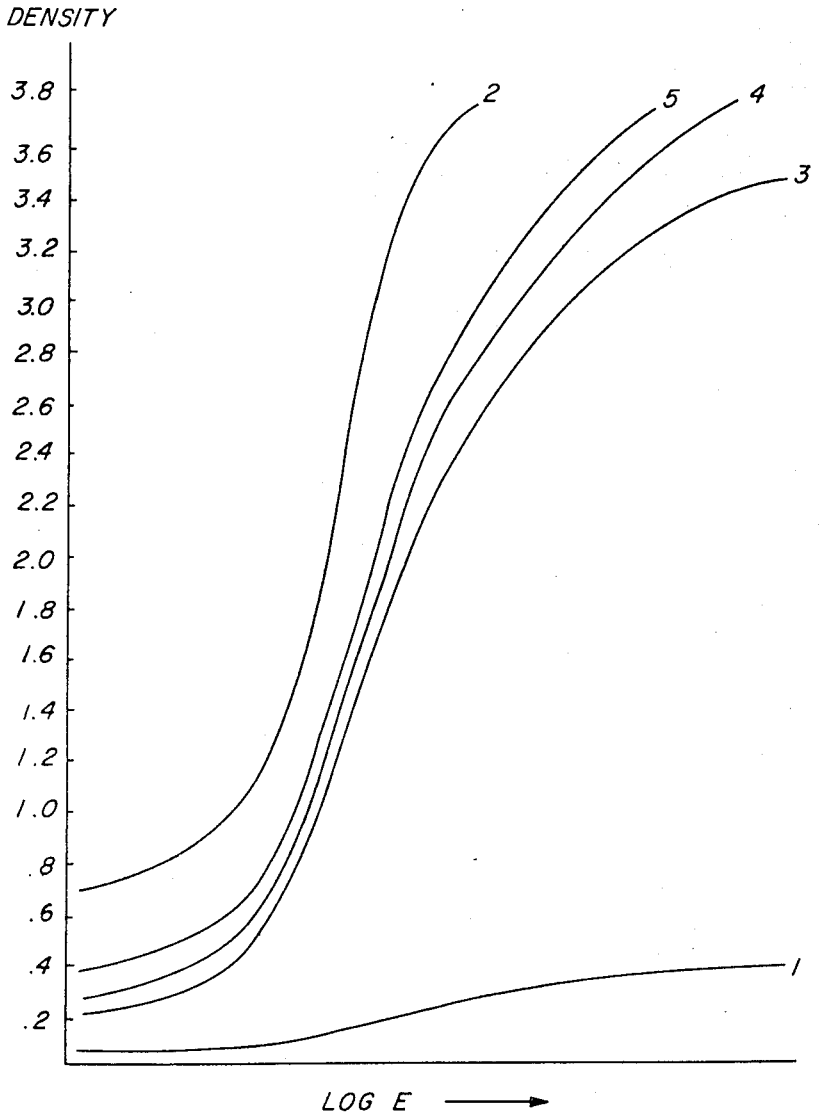

Eight samples of film emulsion coatings prepared as described in Example 1 are exposed, developed to a negative silver image by the procedure described in Example 1, fixed, washed and dried. The sensitometric curves (read through a Status A Red Filter as described in Example 1) of the silver image in each sample are represented by Curve 1 in FIG. 2.

A. Each of the eight samples is then treated for 16 min. at a temperature of 24° C. (75° F.) in Processing Solutions 2, 3, 4 and 5 respectively, followed by a 2-min. wash, a 5-min. fix, a 5-min. wash, and drying.

| | Processing Solutions (quantities in g./liter, pH 11.0) | | | | | | |
|---|---|---|---|---|---|---|---|
| | | | | Color-Developing Agent** | | | |
| No. | $Na_2SO_3$ | EDTA | Borax | D II | D III | D IV | D V |
| 2 | 10.0 | 8.0 | 10.0 | 4.0 | — | — | — |
| 3 | 10.0 | 8.0 | 10.0 | — | 8.2 | — | — |
| 4 | 10.0 | 8.0 | 10.0 | — | — | 5.2 | — |
| 5 | 10.0 | 8.0 | 10.0 | — | — | — | 9.3 |

**identification of color-developing agents:
D II. 4-amino-3-methyl-N,N-diethylaniline
D III. 4-amino-3-methyl-N-ethyl-N-β-(methanesulfonamido)ethylaniline
D IV. 4-amino-N-ethyl-N-β-hydroxyethylaniline
D V. 4-amino-3-methyl-(N-ethyl-N-β-methoxyethyl)aniline-1,5-naphthalenedisulfonate The image in each of the four samples is represented by sensitometric Curve 1 in FIG. 2. Notice that all curves are superimposable with each other and with the black-and-white developed sample. No increase in density is recorded. Processing Solutions 2, 3, 4 and 5 at this point do not contain an oxidizing agent-reducing agent combination according to this invention B. The remaining four samples are treated by the procedure described in (A), with the exception that each processing solution contains 2.5 g./liter of $[Co(NH_3)6]Cl_3$. The images obtained are represented by Curves 2, 3, 4 and 5 in FIG. 2. From the above example, it is apparent that a variety of reducing agents can be employed in the practice of this invention.

The color developer (reducing agent) 4-amino-2,6-dibromophenol gives results generally similar to the results with color developers (reducing agents A–D. Also, generally similar results are obtained when the hexammine cobalt(III) chloride is replaced with other oxidizing agents having complex cations, such as $[Co(en)_2(N_3)_2]^{+1}$, $[Co(en_2Cl(NCS)]^{+1}$, $[Co(en)_2(NH_3)_2N_3]^{+2}$, $[Co(en)_2Cl_2]^{+1}$, $[Co(en_2(SCN)_2]^{+1}$ and $[Co(en)_2(NCS)_2]^{+1}$. In addition, generally similar results are obtained when Example 3 is repeated using film emulsion coatings containing, in place of the cyan dye-forming coupler, 150 mg. of a magenta dye-forming coupler, e.g., Coupler II, 1-(2,4,6-trichlorophenyl)-3-[3-{α-(3-pentadecylphenoxy)butyramido}benzamido-5-pyrazolone, of U.S. Pat. No. 2,908,573, or a yellow dye-forming coupler, e.g., Coupler III, α-pivalyl-α-(4-carboxyphenoxy)-2-chloro-5-[γ-(2,4-di-tert-amylphenoxy)butyramido]acetanilide, of U.S. Pat. No. 3,408,194. Generally similar results are obtained with somewhat lower dye densities when the film emulsion coating contains a silver coverage of 10 mg. of Ag/ft.$^2$ instead of the usual 100 mg./ft.$^2$.

EXAMPLE 5

A. Four samples of the film coating described in Example 1 are exposed through a 0.3 neutral density step tablet in an intensity-scale sensitometer and treated for 45 sec. at 24° C. (75° F.) in a commercial fixing bath containing ammonium thiosulfate and washed for 30 sec. The samples now contain nonvisible latent image silver specks in proportion to the intensity of the initial exposure, but no developable silver halide.

B. Two of the samples designated A and B are treated for 2 and 4 hr., respectively, with a processing solution of the following composition:

| | |
|---|---|
| 4-amino-N-ethyl-N-β-hydroxyethylaniline | 20.0 g. |
| piperidino hexose reductone | 1.0 g. |
| $Na_2SO_3$ | 40.0 g. |
| KBr | 2.0 g. |
| EDTA | 0.5 g. |
| $H_2O$ to 1 liter | |
| pH 11.0 | |

The two samples are washed for 5 min. and dried.

Figure 3:
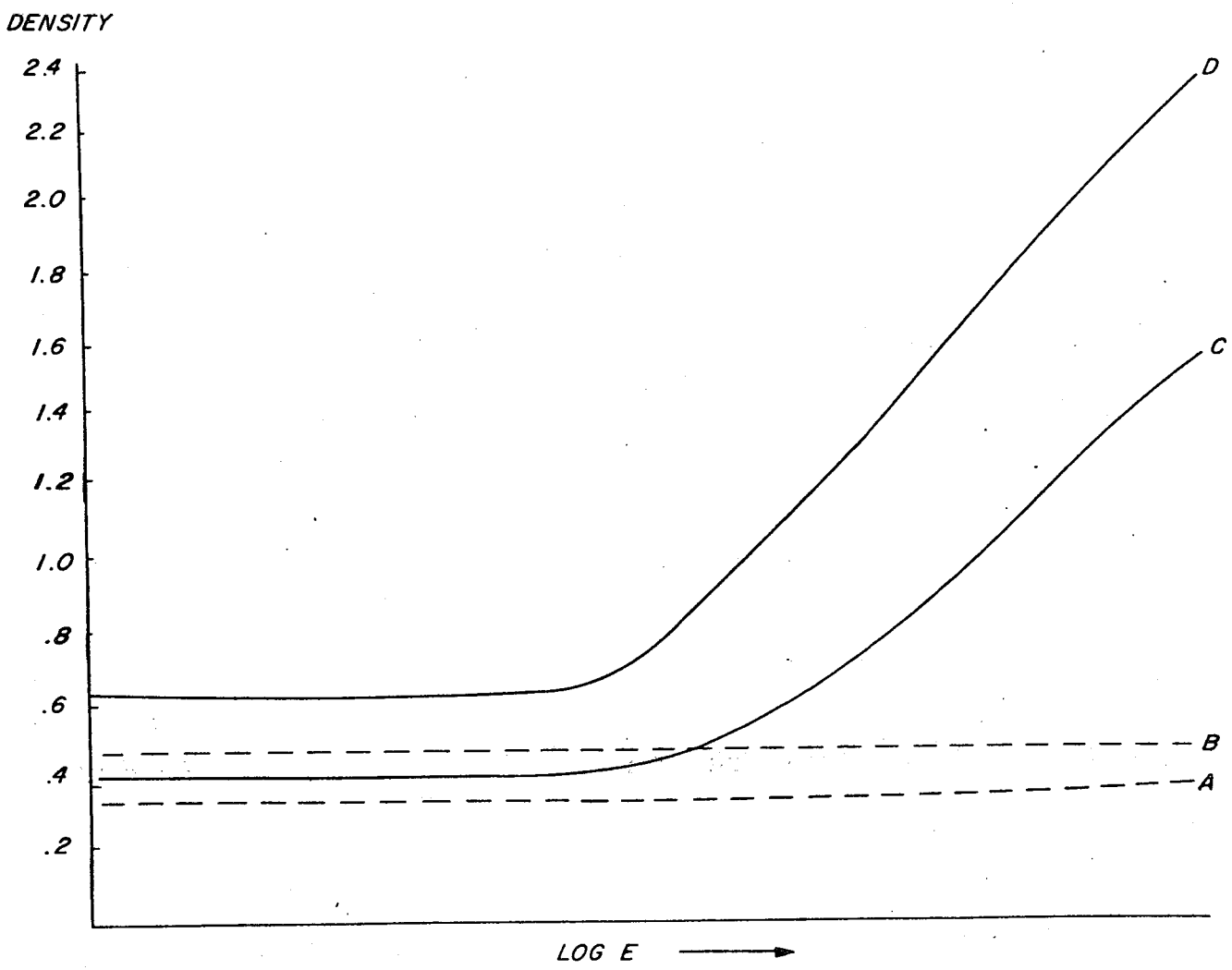

C. The other two samples designated C and D are treated by the procedure described in (B), but with 10.0 g./liter of the oxidizing agent $[Co(NH_3)_6]Cl_3$ added to the processing solution. This solution thus contains an oxidizing agent-reducing agent combination in accordance with this invention. The images in the samples are read sensitometrically through Status A Red Filter as defined in Example 1. The sensitometric curves obtained with the sample developed according to (B) are represented in FIG. 3 by Curves A and B. The sensitometric curves obtained with the samples developed according to (C) are represented by Curves C and D. These curves show that only a fog density is produced with samples A and B treated without oxidizing agent in the processing solution. The strips treated with the oxidizing agent-reducing agent combination of this invention produce a normal curve (see Curves C and D, FIG. 3). These data show that very small amounts of catalyst such as latent image-size silver particles can be used to produce images of good intensity in accordance with this invention.

EXAMPLE 6

Two examples A and B of a film having a fine-grained gelatin silver bromoiodide emulsion, which is 94 mole percent bromide and 6 mole percent iodide, are exposed for 5 sec. through a 0.3 neutral density step tablet. Each sample is treated for 30 sec. at 24° C. (75° F.) in a dilute sodium thiosulfate fix and washed for 1 min. The samples now contain only nonvisible latent image silver specks but no developable silver halide. Sample A (control) is treated for 15 min. at 24° C. (75° F.) in a solution consisting of:

| | |
|---|---|
| Kodak D-72 Developer (stock solution) | 4 ml. |
| water | 16 ml. |
| 5 % aqueous solution of 8-hydroxyquinoline | 5 ml. |

Sample B is similarly treated in the same solution to which has been added 0.15 g. of $[Co(NH_3)_6]Cl_3$.

No visible image is noted in control sample A. Sample B has a red image, the density of which is proportional to the light exposure of the sample.

EXAMPLE 7

Two sets of four photographic film samples are prepared by coating on a cellulose acetate support a single layer of a gelatinous silver halide emulsion containing gelatin at 300 mg./ft.$^2$, silver bromoiodide at 100 mg. of Ag/ft.$^2$, and 150 mg./ft.$^2$ of the color coupler 5-[$\alpha$-(2,4-di-tert-amylphenoxy)hexamido]-2-heptafluorobutyramidophenol dissolved in 75 mg. of dibutyl phthalate. The film samples are exposed through a 0.3 neutral density step tablet in an intensity-scale sensitometer.

A. Four of the film samples are processed at 24° C. (75° F.) in the following sequence:

| | |
|---|---|
| development (in Processing Solution 1 of Example 1 for 1, 2, 4 and 8 min.) | |
| wash | 2 min. |
| bleach | 5 min. |
| wash | 2 min. |
| fix | 5 min. |
| wash | 5 min. |
| dry | |

Figure 4:
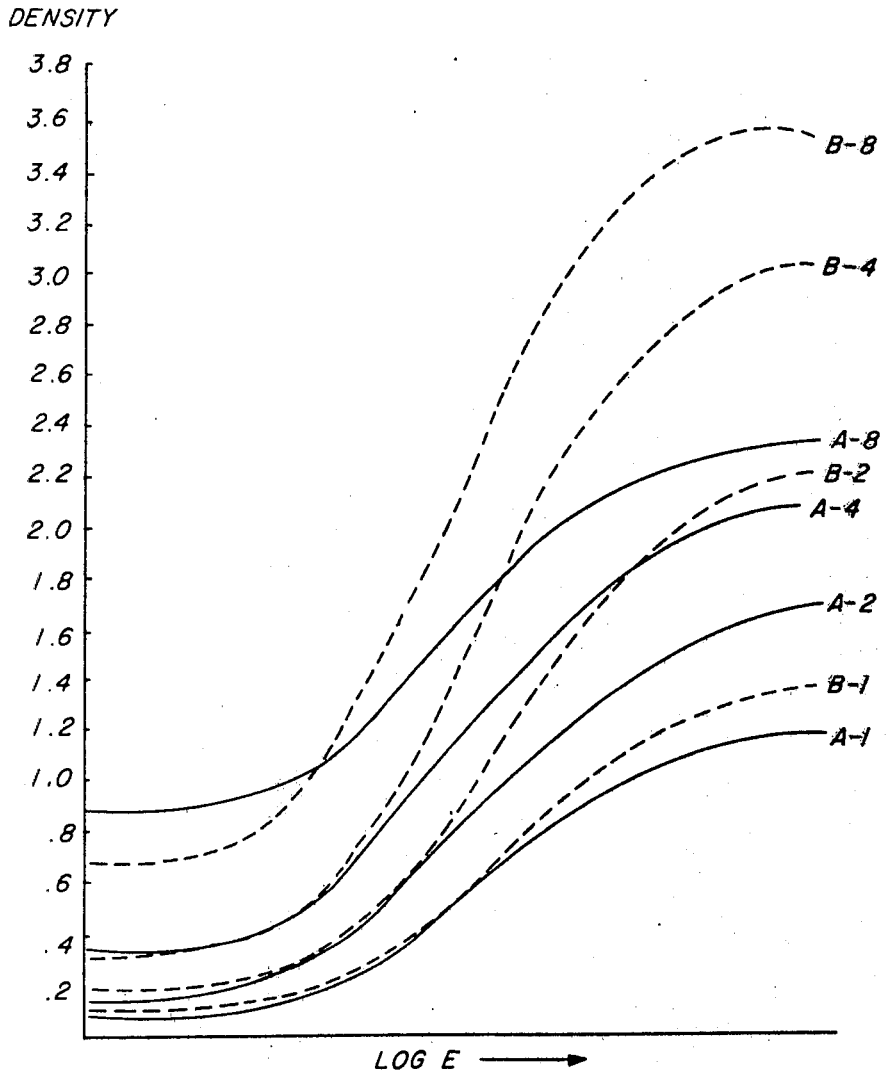

B. The remaining four film samples are processed according to (A) except that the processing solution additionally contains 2.5 g./liter of $[Co(NH_3)_6]Cl_3$. The sensitometric curves of the cyan dye images in the eight processed samples are represented in FIG. 4 by Curves A-1, A-2, A-4, A-8, B-1, B-2, B-4 and B-8. This set of curves illustrates the higher maximum image-dye densities and improved image-to-fog ratios which are obtained in the samples processed in a color-developing solution according to the present invention.

EXAMPLE 8

Figure 5:
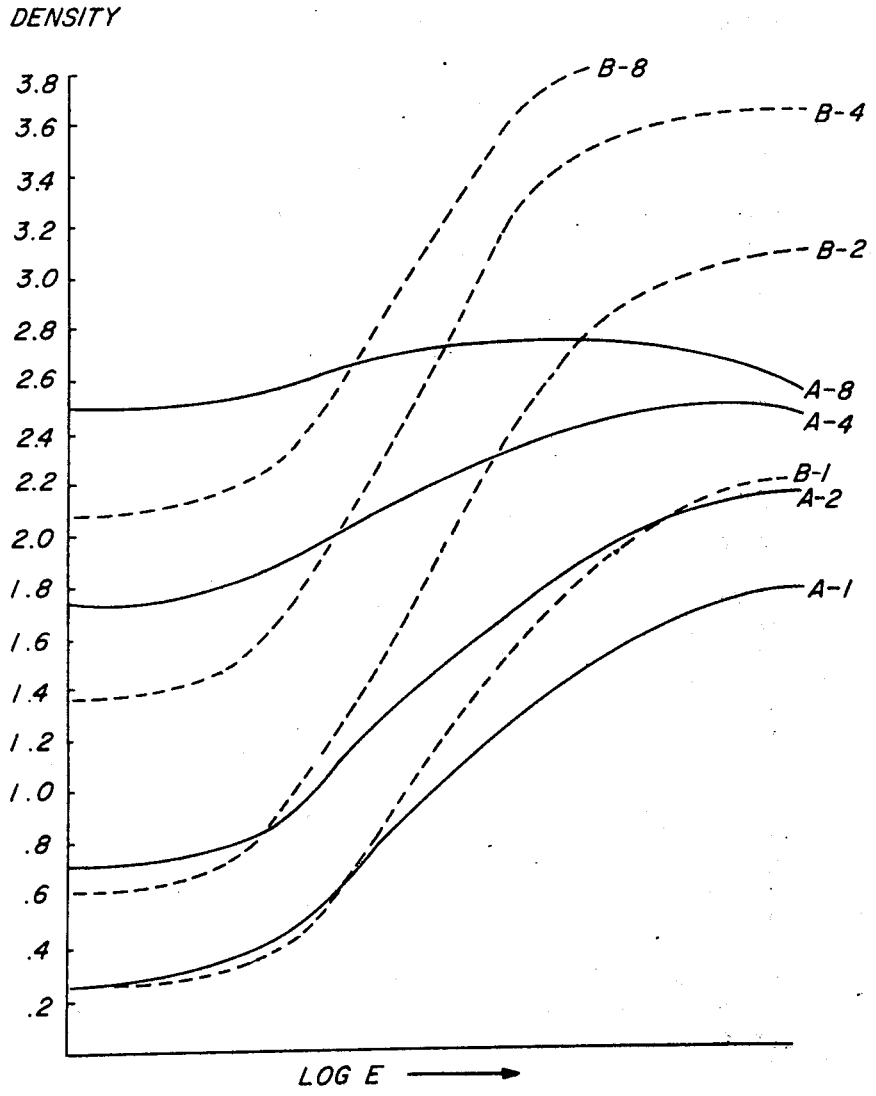

The procedures described in Example 6 are repeated with the processing solutions at a temperature of 32° C. (90° F.). The sensitometric curves are shown in FIG. 5. Similar results are obtained when the procedures described in Example 6 are repeated at a temperature of 43° C. (110° F.).

EXAMPLE 9

A photographic matrix is prepared by exposing a sample of a fine-grained, negative-type film having a gelatin-silver bromoiodide emulsion which is 94 mole percent bromide and 6 mole percent iodide through a 0.3 neutral density step tablet in an intensity-scale sensitometer, developing at 24° C. (75° F.) for 2 min. in Kodak D-72 Developer diluted 1:1 with water, washing for 2 min., fixing for 5 min., washing for 5 min. and drying to give a negative silver image having a Dmax of 0.64 and a Dmin of 0.09. A photographic receiving element is prepared by imbibing a single-layer mordant coating of a mixture of 60 parts of methyl-tri-n-dodecylammonium-p-toluenesulfonate and 30 parts of N-n-hexadecyl-N-morpholinium ethosulfate on a support in a 0.5 percent by weight aqueous solution of 8-hydroxyquinoline, adjusting to pH 11, for 1 min. at 24° C. (75° F.) and washing for 30 sec. The matrix and receiving element are then processed in the following sequence at 24° C. (75° F.):

Step 1. The matrix and the receiving element are immersed in an aqueous solution consisting of 500 ml. of the above black-and-white developer and 500 ml. of a 1 percent solution of $[Co(NH_3)_6]Cl_3$.

Step 2. The matrix and receiving element are pressed together and allowed to stand for 5 min., during which time the developer and $[Co(NH_3)_6]$ $Cl_3$ undergo a redox reaction where they come in contact with the silver image catalyst. A reduced form of the oxidizing agent containing cobalt(II) ions migrates in an imagewise pattern to the receiving element. The matrix and receiving image are separated. The matrix is washed for 5 min. and dried. The Dmax and Dmin of the silver image in the matrix remain unchanged. The receiving element is washed for 1 min. and immersed for 30 sec. in an aqueous solution containing 20.0 g. of the color developer 4-amino-N-ethyl-N-$\beta$-hydroxyethylaniline sulfate and 40.0 g. of sodium sulfite (pH 11). The color developer is oxidized by immersing the receiving element in a 1 percent aqueous solution of potassium persulfate ($K_2S_2O_8$) (pH 11) for 30 sec., followed by a 5-min. wash. The oxidized color developer couples with 8-hydroxyquinoline except in areas where coupling is inhibited by the migrated cobalt(II) ions to form a positive cyan dye image having a Dmax of 0.51 and a Dmin of 0.34. This example demonstrates the imagewise poisoning of the color coupler by a product of the reaction of an oxidizing agent and a reducing agent in the presence of a catalyst according to this invention.

EXAMPLE 10

A reversal-type, multicolor photographic element is prepared by coating a polyethylene-coated, titanium dioxide pigmented paper with the following layers (all weights are in mg./ft.$^2$):

1. an emulsion of gelatin, 200 mg.; blue-sensitized silver chlorobromide, 40 mg.; having dispersed therein a solution of 120 mg. of the yellow dye-forming coupler $\alpha$-[4-(4-benzyloxyphenylsulfonyl)phenoxy]-$\alpha$-pivalyl-2-chloro-5-[$\gamma$-(2,4-ditert-amylphenoxy)-butyramido]acetanilide dissolved in 30 mg. of di-n-butyl phthalate;
2. gelatin, 100 mg.;
3. an emulsion of gelatin, 200 mg.; green-sensitized silver chlorobromide, 8 mg.; having dispersed therein a solution of 30 mg. of the magenta dye-forming coupler 1-(2,4,6-trichlorophenyl)-3-{5-[α-(3-tert-butyl-4-hydroxyphenoxy)tetradecanamido]-2-chloroanilino}-5-pyrazolone dissolved in 15 mg. of tricresyl phosphate;

4. gelatin, 241 mg.; having dispersed therein a solution of 65 mg. of the filter dye 2-(2′-hydroxy-3′,5′-di-tert-amylphenyl)benzotriazole dissolved in 2-(2-butoxyethoxy)ethyl acetate, 32.5 mg.;
5. an emulsion of gelatin, 150 mg.; red-sensitized silver chlorobromide, 5.25 mg.; having dispersed therein a solution of 23.4 mg. of the cyan dye-forming coupler 2-[α-(2,4-di-tert-amylphenoxy)butyramido]-4,6-dichloro-5-methylphenol dissolved in 11.7 mg. of di-n-butyl phthalate;
6. gelatin, 100 mg.

A control strip 1of the above multicolor photographic element is exposed through a 0.3 neutral density step tablet in an intensity sensitometer and processed at 30° C. (85° F.) as follows:

| | | |
|---|---|---|
| develop in black-and-white developer* | 1.5 | min. |
| acid stop bath | 1 | min. |
| wash | 1 | min. |
| re-expose to white light, color-develop** | 10 | min. |
| bleach-fix | 1.5 | min. |
| wash | 1 | min. |
| stabilize | 1 | min. |
| *Black-and-White Developer Solution | | |
| N-methyl-p-aminophenol | 2 | g. |
| sodium sulfite, anh. 90 | g. | |
| hydroquinone | 8 | g. |
| sodium carbonate, monohydrate | 52.5 | g. |
| potassium bromide | 5 | g. |
| water to make 1 liter | | |
| **Color-Developer Solution | | |
| benzyl alcohol | 10.0 | ml. |
| sodium sulfite, anh. | 2.0 | g. |
| hydroxylamine sulfate | 2.0 | g. |
| sodium bromide | 0.5 | g. |
| sodium chloride | 0.5 | g. |
| 4-amino-N-ethyl-N-(2-methoxyethyl)-m-toluidine-di-p-toluenesulfonate | 5.0 | g. |
| sodium carbonate, anh. | 30.0 | g. |
| water to make 1 liter | | |
| pH 10.75 at 75° F. | | |

Strip 2 of the above multicolor photographic element is exposed and processed in the same manner as strip 1, except that 1.6 g./liter of $[Co(NH_3)6]Cl_3$ is added to the colordeveloper solution.

Strip 3 of the same multicolor photographic element is exposed in the same manner as strips 1 and 2. Strip 3 is processed at 30° C. (85° F.) in the following sequence:

| | | |
|---|---|---|
| develop (above black-and-white developer) | 1.5 | min. |
| acid stop bath | 1 | min. |
| wash | 1 | min. |
| bleach* | 1 | min. |
| clear** | 1 | min. |
| wash | 1 | min. |
| re-exposed to white light, color-develop (above color developer containing 1.6 g./liter of $[Co(NH_3)_6]Cl_3$ | 10 | min. |
| bleach-fix | 1.5 | min. |
| wash | 2 | min. |
| stabilize | 1 | min. |
| *Bleach Formula | | |
| potassium dichromate | 10 | g. |
| sodium sulfate | 50 | g. |
| sodium bisulfate | 50 | g. |
| water to make 1 liter | | |
| **Clearing Bath Formula | | |
| sodium sulfite, anh. | 101.07 | g. |
| water to make 1 liter | | |

The Dmax and Dmin of the dye images obtained with strips 1, 2 and 3 are set forth in Table 1 below:

Table 1

| | Strip (1) (control) | | Strip (2) | | Strip (3) | |
|---|---|---|---|---|---|---|
| | Dmin | Dmax | Dmin | Dmax | Dmin | Dmax |
| red | 0.15 | 0.72 | 1.6 | 1.6 | 0.19 | 1.6 |
| green | 0.17 | 1.03 | 2.4 | 2.4 | 0.18 | 2.4 |
| blue | 0.18 | 1.27 | 1.8 | 1.8 | 0.20 | 1.8 |

From the data in Table 1, it can be seen that a reversal-type, multicolor photographic element (strip 3) processed according to this invention is capable of producing dye images of low Dmin and higher Dmax than an element (strip 1) processed according to conventional methods. Strip 2 having Dmin values equal to Dmax shows that a bleach step is necessary after the black-and-white development step and before the color-development step when using a color developer according to the present invention because the developed silver from the black-and-white development step catalyzes the oxidation-reduction reaction between the hexammine cobalt (III) chloride and the primary amino color developer.

EXAMPLE 11

A faint image is produced on white pigmented titanium dioxide paper coated with a layer of unhardened gelatin by exposing a line copy in a commercial xerographic copying machine using as the toner a very finely ground activated carbon, heating the toned gelatin surface to just above its softening point under an infrared lamp, cooling the surface, and removing unattached carbon with a high-velocity air jet. The image-bearing paper is treated for 20 min. in a solution containing:

| | | |
|---|---|---|
| 4-amino-N-ethyl-N-(2-methoxyethyl)-m-toluidine | 5 | g. |
| $[Co(NH_3)_6]Cl_3$ | 1.6 | g. |
| 1-phenyl-3-methyl-5-pyrazolone | 4 | g. |
| sodium sulfite, anh. | 5 | g. |
| potassium carbonate | 60 | g. |
| potassium bromide | 2 | g. |
| water to make 1 liter | | |

The paper is washed for 2 min. and dried. The faint carbon image is intensified with a dense magenta image.

EXAMPLE 12

An image-forming element is prepared by coating a polyethylene-coated, titanium dioxide pigmented paper with an emulsion containing:

| | |
|---|---|
| $[Co(en)_2(N_3)_2]ClO_4$ | 50 mg./ft.$^2$ |
| p-phenylenediamine | 13 mg./ft.$^2$ |

-continued

| | |
|---|---|
| 1-naphthol | 16 mg./ft.$^2$ |
| gelatin | 150 mg./ft.$^2$ |

On the surface of the element is printed with a rubber stamp a freshly prepared suspension of colloidal gold made by mixing:

| | |
|---|---|
| auric chloride | 1 g. |
| stannous chloride | 1 g. |
| water to 1 liter | |

to form an imagewise distribution of metallic gold nuclei as a catalyst for the redox reaction according to this invention. The element is placed in an atmosphere having 100 % relative humidity for 3 hr., in which time a cyan dye image forms corresponding to the imagewise distribution of gold nuclei.

EXAMPLE 13.

To 269 ml. of water and 11 ml. of a 10% ethylenediaminetetraacetic acid are added, with stirring, 280 g. of a particulate titanium dioxide marketed under the designation Unitane-0520 by American Cyanamid Company. To this mixture is then added a first solution containing 320 ml. of 7.5% polyvinyl alcohol and 11 ml. of a 10% aqueous solution of a condensed sulfonic acid sodium salt marketed as Tamol N by Rohm and Haas Company, and a second solution containing 2 ml. of 7.5% saponin and 10 ml. of a 0.1% aqueous tannic acid solution. After the addition of the tannic acid, the solution becomes deeper yellow in color. This composite mixture constitutes a coating solution wherein the tannic acid is present as a complexing ligand bearing ortho-hydroxyl substituents as chelating moieties. The coating solution is then coated at a 0.004-in. wet thickness on polyethylene-coated paper and dried, thereby producing a completed photographic element. A portion of the element so prepared is exposed to a stepped density wedge for 15 sec. and immersed in a 1 % aqueous silver nitrate solution for 5 sec. to produce an imagewise distribution of silver nuclei. The element is then immersed for 30 min. in a solution containing:

| | |
|---|---|
| $[Co(en)_2(NCS)_2]SCN$ | 50 g. |
| 4-amino-N,N-diethylaniline | 15 g. |
| 1-naphthol | 16 g. |
| water to 1 liter | |

washed and dried. A cyan dye image of good density is obtained.

EXAMPLE 14

Six samples of a fine-grained, negative-type film having a gelatin-silver bromoiodide emulsion, which is 94 mole percent bromide and 6 mole percent iodide, are exposed through a 0.3 neutral density step tablet in an intensity-scale sensitometer and processed at 24° C. (75° F.) in the following sequence:

| | | |
|---|---|---|
| Kodak D-72 Developer (diluted 1:1 with water) | 2 | min. |
| wash | 0.5 | min. |
| fix | 5 | min. |
| wash | 5 | min. |
| dry | | |

Each sample now contains a predeveloped silver image which is a negative reproduction of the neutral density step tablet. One of these samples 1 is retained as a control.

One predeveloped sample 2is treated for 8 min. at 24° C. (75° F.) in a solution containing 2.5 g. of the formazan dye o-{2-[α-(2-hydroxy-5-sulfophenylazo)-benzylidene]hydrazino}-benzoic acid, sodium salt, in 1 liter of water (pH adjusted to 9.8 with NaOH). The treated sample is immersed for 2 min. in a 0.5% w. NaOH solution, washed 2 min. in water, fixed 5 min., washed 5 min. and dried.

Another predeveloped sample 3 is treated for 8 min. at 24° C. (75° F.) in a solution containing 10 g. of hexammine cobalt(III) chloride in 1 liter of water (pH adjusted to 9.8 with NaOH), washed 2 min. in a 0.5% w. NaOH solution, washed 2 min. in water, fixed 5 min., washed 5 min. and dried.

The three remaining predeveloped samples (4, 5 and 6) are treated for 2, 4 and 8 min., respectively, at 24° C. (75° F.) in a solution containing 2.5 g. of the formazan dye o-{2 -[α-(2-hydroxy-5-sulfophenylazo)benzylidene]hydrazino}benzoic acid, sodium salt, and 10 g. of hexammine cobalt(III) chloride in 1 liter of water with the pH adjusted to 9.8 with NaOH, washed 2 min. in 0.5% w. NaOH solution, washed 2 min. in water, fixed 5 min., washed 5 min. and dried.

Figure 6:
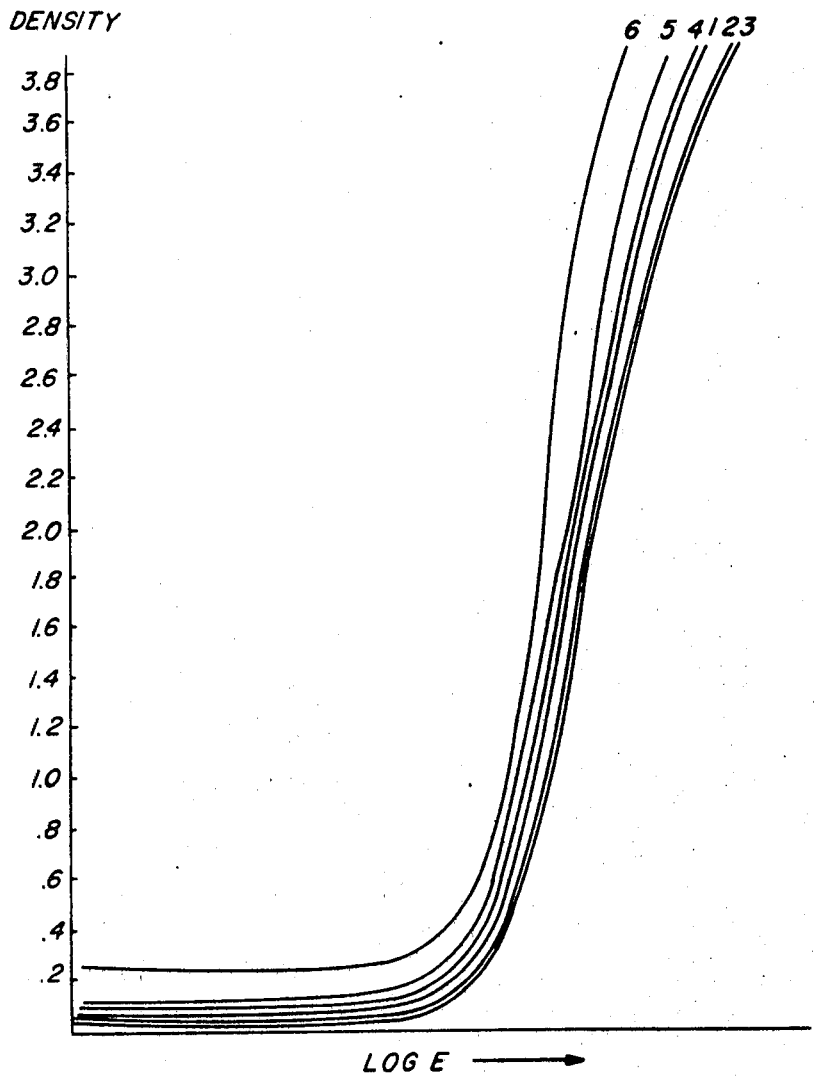

The image in each of the treated samples is sensitometrically recorded through a Status A Red Filter as described in Example 1. The resulting sensitometric curves are shown in FIG. 6. Samples 2 and 3 (curves 2 and 3 respectively) treated in solutions containing formazan dye or hexammine cobalt(III) chloride separately show slight decreases in density when compared with the control (curve 1). Samples 4, 5 and 6 (curves 4, 5 and 6 respectively) treated for varying lengths of time in a solution containing both the formazan dye and hexammine cobalt (III) chloride shown increased densities with increased treatment time.

EXAMPLE 15

A light-sensitive silver dye emulsion is prepared according to Gilman et al., U.S. Pat. No. 3,446,619, and coated on a grey support which has a density through a Red Filter of 0.30. The coated emulsion contains per square foot 5.6 mg. of $AgNO_3$, 400 mg. of gelatin, 130 mg. of the cyan dye-forming coupler 5-[α-(2,4-di-tert-amylphenoxy)hexamido]-2-heptafluorobutyramidophenol dissolved in 65 mg. of the coupler solvent dibutyl phthalate, and 0.066 mg. of the sensitizing dye 1 carboxymethyl5-[3-ethyl-2-benzoxazolinylidene)ethylidene]-3-phenyl-2-thiohydantoin.

Test strip 1 of the photographic element is exposed through a graduated-density test object and developed in Processing Solution 1 for 15 min. at 30° C. (85° F.), washed, fixed, washed and dried.

| Processing Solution 1 | | |
|---|---|---|
| 4-amino-N-ethyl-N-β-hydroxyethylaniline sulfate | 10.0 | g. |
| sodium sulfite | 10.0 | g. |
| sodium bromide | 1.0 | g. |
| sodium carbonate, anh. | 30.0 | g. |
| tetrasodium salt of ethylenediamine- | 1.0 | g. |

-continued

| Processing Solution 1 | | |
|---|---|---|
| tetraacetic acid | | |
| benzyl alcohol | 5.0 | ml. |
| water to make 1 liter (pH 10.8) | | |

The above procedure is repeated with test strips 2–9 except that 1.6 g./liter of $[Co(NH_3)_6]Cl_3$ is added to Processing Solution 1 and the pH of Processing Solution 1 is adjusted to 9.3, 9.5, 10.0, 10.2, 10.4 and 10.8. These test strips are developed for 15 min. except where the pH is 10.8, in which instance separate strips are developed for 5, 10 and 15 min. Further, the above procedure is repeated with test strip 10 developed in Processing Solution 1 at pH 10 at 38° C. (75° F.) for 15 min. The above procedure is again repeated except that the test strips 11 and 12 are developed for 15 min. at 30° C. (85° F.) respectively in Processing Solution 2 and in Processing Solution 2 with 1.6 g./liter of $[Co(NH_3)_6]$ added.

| Processing Solution 2 | | |
|---|---|---|
| 4-amino-3-methyl-(N-ethyl-N-2-methoxy-ethyl)aniline dibenzene sulfonate | 5.0 | g. |
| sodium sulfite | 10.0 | g. |
| sodium bromide | 1.0 | g. |
| sodium carbonate, anh. | 30.0 | g. |
| tetrasodium salt of ethylenediamine-tetraacetic acid | 1.0 | g. |
| benzyl alcohol | 5.0 | ml. |
| water to make 1 liter (pH 10.8) | | |

The dye densities of the test strips read through a Red Filter are recorded in the table below:

| Test Strip | Processing Solution | $[Co(NH_3)]Cl_3$ (g.) | pH | Development Time (min.) | Temperature (° C.) | Dmin | Dmax |
|---|---|---|---|---|---|---|---|
| 1 | 1 | 0 | 10.8 | 15 | 30 | 0.30 | 0.50 |
| 2 | 1 | 1.6 | 9.3 | 15 | 30 | 0.34 | 0.78 |
| 3 | 1 | 1.6 | 9.5 | 15 | 30 | 0.38 | 1.14 |
| 4 | 1 | 1.6 | 10.0 | 15 | 30 | 0.40 | 1.35 |
| 5 | 1 | 1.6 | 10.2 | 15 | 30 | 0.44 | 1.50 |
| 6 | 1 | 1.6 | 10.4 | 15 | 30 | 0.48 | 1.70 |
| 7 | 1 | 1.6 | 10.8 | 5 | 30 | 0.45 | 1.08 |
| 8 | 1 | 1.6 | 10.8 | 10 | 30 | 0.60 | 1.60 |
| 9 | 1 | 1.6 | 10.8 | 15 | 30 | 0.77 | 2.18 |
| 10 | 1 | 1.6 | 10.0 | 15 | 38 | 0.62 | 2.60 |
| 11 | 2 | 0 | 10.8 | 15 | 30 | 0.28 | 0.32 |
| 12 | 2 | 1.6 | 10.8 | 15 | 30 | 0.69 | 1.72 |

EXAMPLE 16

A film sample is prepared by coating a cellulose acetate film base with a gelatin silver chlorobromide internalimage emulsion prepared as described in Fallensen, U.S. Pat. No. 2,497,875 issued Feb. 21, 1950, at column 2, line 21, through column 3, line 2, containing 100 mg./ft.$^2$ of silver and 100 mg./ft.$^2$ of the cyan dye-forming coupler 5 -[α-(2,4-di-tert-amylphenoxy)hexamido]-2-heptafluorobutyramidophenol. Four samples of the film are exposed through a 0.3 neutral density step tablet and one sample is developed for 1 min. at 24° C. (75° F.) in each of developer solutions A, B, C and D which contain O, 0.25, 0.50 and 1.0 g./liter, respectively, of $[Co(NH_3)_6]Cl_3$ added to the following stock solution:

| | | |
|---|---|---|
| formyl-4-methylphenylhydrazine | 0.1 | g. |
| sodium carbonate, anh. | 40.0 | g. |

-continued

| | | |
|---|---|---|
| piperidino hexose reductone | 0.2 | g. |
| 5-methylbenzimidazole | 0.05 | g. |
| 4-amino-N-ethyl-N-β-hydroxyethylaniline sulfate | 20.0 | g. |
| water to make 1 liter (pH 12.0) | | |

Each sample is then stopped, fixed, bleached, fixed, washed and dried. Image densities are read through a Status A Red Filter as described in Example 1. Relative speed and Dmax are recorded in the following table:

| Developing Solution | $[Co(NH_3)_6]Cl_3$ (g./liter) | Dmax | Relative Speed |
|---|---|---|---|
| A (control) | 0 | 0.2 | 1.6 |
| B | 0.25 | 1.7 | 1.9 |
| C | 0.50 | 2.8 | 1.9 |
| D | 1.00 | 2.7 | 2.0 |

EXAMPLE 17

One sample of the film as used and exposed in Example 17 is developed for 1 min. at 24° C. (75° F.) in each of developer solutions E through K containing 0, 0.1, 0.25, 0.5, 1.0, 2.5 and 5 g./liter, respectively, of $[Co(NH_3)_6]Cl_3$ added to the following stock solution:

| | | |
|---|---|---|
| formyl-4-methylphenylhydrazone | 0.1 | g. |
| sodium carbonate, anh. | 40.0 | g. |
| sodium sulfite | 2.0 | g. |
| 5-methylbenzimidazole | 0.05 | g. |
| 4-amino-N-ethyl-N-β-hydroxyethylaniline sulfate | 20.0 | g. |
| water to make 1 liter (pH 12.0) | | |

Each sample is stopped, fixed, bleached, fixed, washed and dried. Image densities are read through a Status A Red Filter. Relative speed and Dmax are recorded in the table below:

| Developer | $[Co(NH_3)_6]Cl_3$ (g./liter) | Dmax | Relative Speed |
|---|---|---|---|
| E (control) | 0 | 0.70 | 1.65 |
| F | 0.1 | 1.05 | 1.90 |
| G | 0.25 | 1.05 | 2.00 |
| H | 0.50 | 1.30 | 2.00 |
| I | 1.0 | 1.80 | 2.10 |
| J | 2.5 | 2.60 | 2.10 |
| K | 5.0 | 2.65 | 1.95 |

EXAMPLE 18

Test strip A (control) of a fine-grained, negative-type film having a gelatin-silver bromoiodide emulsion, which is 94 mole percent bromide and 6 mole percent iodide, is exposed through a 0.3 neutral density step tablet and developed for 5 min. at 24° C. (75° F.) in the stock developer solution:

| | |
|---|---|
| 2,4-diaminophenol | 7.3 g. |
| sodium sulfite | 23.0 g. |
| potassium bromide | 0.3 g. |
| water to make 1 liter (pH 6.90 unadjusted | |

The strip is then washed, fixed, washed and dried.

Test strip B of the same film is processed in the same manner as test strip A except that 5.0 g/liter of $[Co(NH_3)_6]Cl_3$ are added to the stock developer solution.

Test strip C of the same film is processed in the same manner as test strip A except that 10.0 g/liter of EDTA (ethylenediaminetetraacetic acid) are added to the stock developer solution (EDTA is chelating agent which forms a complex with cobalt(II) ions).

Test strip D of the same film is processed in the same manner as test strip A except that 5.0 g./liter of $[Co(NH_3)_6]Cl_3$ and 10.0 g./liter of EDTA are added to the stock developer solution.

Image densities of the test strips are read through a Status A Blue Filter and recorded in the table below:

| Test Strip | Developer $[Co(NH_3)_6]Cl_3$ (g./liter | Additives EDTA (g./liter) | Dye + Silver Image | | Dye Image | |
|---|---|---|---|---|---|---|
| | | | Dmin | Dmax | Dmin | Dmax |
| A | 0 | 0 | 0.30 | 2.74 | 0.08 | 0.32 |
| B | 5.0 | 0 | 0.40 | >3.80 | 0.14 | 2.58 |
| C | 0 | 10.0 | 0.30 | 2.70 | — | — |
| D | 5.0 | 10.0 | 0.50 | 3.08 | — | — |

Test strip B developed according to the process of this invention has a silver image and a dye image which is formed by a reaction of cobalt(II) ions with diaminophenol developer.

EXAMPLE 19

A photographic film element is prepared as follows (with all ingredients as listed in mg./ft.$^2$):

1. cellulose acetate support;
2. a layer containing a blue-sensitive silver bromoiodide emulsion (1.14% iodide) at 61 mg. of Ag (1.0-micron grain), the yellow dye-forming coupler (α-pivalyl-α-(4-carboxyphenoxy-2-chloro-5-[γ-(2,4-di-tert-amylphenoxy)butyramido]acetanilide at 132 mg. dissolved 1:1 in tricresyl phosphate, and gelatin at 253 mg.;
3. layer containing gelatin at 43 mg.;
4. layer containing a red-sensitive silver chlorobromide (80/20) emulsion (0.25-micron grain size) at 10 mg. of silver, the cyan dye-forming coupler 2-[α-(2,4-di-tert-amylphenoxy)butyramido]-4,6-dichloro-5-methylphenol at 79 mg. dissolved 1:3 in di-n-butyl phthalate, and gelatin at 207 mg.;
5. layer containing gelatin at 43 mg.;
6. layer containing green-sensitive silver chlorobromide (80/20) emulsion (0.25-micron grain size) at 20 mg., the magenta dye-forming coupler 1-(2,4-dimethyl-6-chlorophenyl)-3-[α-(3-n-pentadecylphenoxy)butyramido]-5-pyrazolone at 139 mg. dissolved 1:1 in di-n-butyl phthalate, and gelatin at 162 mg.;
7. layer containing gelatin at 68 mg.

Samples of the film element are exposed on a sensitometer and developed in Developers 19A and 19B for 8 min. at 75° F., fixed, washed, dichromate-bleached, washed, fixed and stabilized.

| Developer 19A | | |
|---|---|---|
| $Na_4EDTA$ | 4 | g./l. |
| $K_2CO_3$ | 40 | g./l. |
| KBr | 2 | g./l. |
| $K_2SO_3$ | 4 | g./l. |
| 4-amino-3-methyl-N,N-diethylaniline hydrochloride | 3.0 | g./l. |
| water to 1 liter | | |
| pH 10.65 at 75° F. | | |

Developer 19B is the same as Developer 19A except 1.6 g./1. of $[Co(NH_3)_6]Cl_3$ are added to the solution.

The densities for the samples processed in Developers 19A and 19B are as follows:

| | Developer A | | Developer B | |
|---|---|---|---|---|
| | Dmin | Dmax | Dmin | Dmax |
| yellow | 0.1 | 3.1 | 0.1 | above 4.6 |
| cyan | 0.1 | 1.6 | 0.1 | above 4.6 |
| magenta | 0.1 | 1.2 | 0.1 | above 4.8 |

It is apparent that photographic film elements having low silver coverages can be processed to provide good image records where cyan, yellow and magenta dyes have high densities in the Dmax areas.

EXAMPLE 20

A photographic element, referred to herein as Film A, is prepared by coating on a transparent cellulose acetate film support a gelatin silver bromoiodide (about 0.6% of the halide being iodide) emulsion at 300 mg. gelatin/ft.$^2$, 150 mg. of the 4-equivalent photographic color coupler 5-[α -(2,4-di-tert-amylphenoxy)hexamido]-2-heptafluorobutyramidophenol dissolved in 75 mg./ft.$^2$ of the coupler solvent dibutyl phthalate, the silver halide being coated at a coverage of 10 mg. of silver/ft.$^2$. The coated layer contains silver to coupler at about a 1:2.5 stoichiometric ratio. Two samples of Film A are then sensitometrically exposed and processed at 24° C. in the following developer:

| | |
|---|---|
| 4-amino-N-ethyl-N-β-hydroxyethylaniline sulfate (color-developing agent) | 20.0 g. |
| 1-phenyl-3-pyrazolidone | 0.1 g. |
| $Na_2SO_3$ | 40.0 g. |
| KBr | 0.5 g. |
| ethylenediamine tetraacetic acid (EDTA) | 8.0 g. |
| cobalt hexammine chloride | 2.5 g. |
| $H_2O$ to 1 liter | |
| pH 11.0 | |

One sample of the exposed film is then developed for 4 min. and the other is developed for 16 min. The developed films are then bleached, fixed and dried in the usual manner. The results obtained show that excellent dye images are produced with low minimum densities (under about 0.4). At the 16-min. and 4-min. development times, the highest maximum densities achieved are approximately 1.5 and 1.1, respectively. Slightly higher silver and coupler coverages produce dye images having maximum densities over 1.7.

EXAMPLE 21

Example 20 is repeated except that the cobalt hexammine chloride is replaced by an equivalent amount of one of the following metal complex oxidizing agents: $[Co(en)_2(dien)]Cl_2 \cdot HCl$, $[Co(NH_3)_5(H_2O](ClO_4)_3$, $[Co(NO_2)_3(NH_3)_3]$, $[Co(NH_3)_4(CO_3)]NO_3$, trans-$[Co(en)_2(Cl)_2]Cl \cdot HCl$, trans-$[Co(en)_2(N_3)(NO_2)]S_2O_6$, $[Co(trien)(NO_2)_2]NO_3 \cdot H_2O$, cis-$[Co(trien)(Cl)_2]Cl$, $[Co(en)_2(NO_2)_2](ClO_4)_3$, $[Co(trien)(N_3)_2]NO_2$, $[Co(en)_2(NH_3)_2]Cl_3$ or $[Co(tn)_2(en)]Cl_3$.

With each of the oxidizing agents a useful but somewhat less dense dye image is obtained.

Although the invention has been described in considerable detail with particular reference to certain preferred embodiments thereof, variations and modifications can be effected within the spirit and scope of the invention.

I claim:

1. A processing composition comprising a reducing agent and an inert transition metal complex oxidizing agent which undergo redox reaction in a liquid medium in the presence of catalytic material which is a zero valent metal or chalcogen of a Group VIII or 1B element, wherein said liquid is a solvent for said reducing agent and said inert transition metal ion complex, said inert transition metal complex comprising (a) Lewis bases and (b) Lewis acids which are capable of existing in at least two valence states and said oxidizing agent and said reducing agent being so chosen that (1) the reaction products thereof are noncatalytic for said oxidation-reduction reaction and (2) when test samples thereof are each dissolved in an inert solvent at a concentration of about 0.01 molar at 20° C., there is essentially no redox reaction between said oxidizing agent and said reducing agent, and said oxidizing agent being a complex of a metal ion with a liquid which, when a test sample thereof is dissolved at 0.1 molar concentration at 20° C. in an inert solvent solution containing a 0.1 molar concentration of a tagged ligand of the same species which is uncoordinated, exhibits essentially no exchange of uncoordinated and coordinated ligands for at least 1 minute.

2. A processing composition as defined in claim 1 wherein said oxidizing agent is a cobalt complex and said reducing agent is capable of reducing silver halide to metallic silver.

3. A processing composition as defined in claim 1 wherein said oxidizing agent is a cobalt complex having a coordination number of 6, said reducing agent is capable of developing exposed silver halide, and said catalytic material is a zero valent metal.

4. A processing composition as defined in claim 1 wherein said composition contains an aqueous alkali-soluble photographic coupler.

5. An aqueous processing composition comprising a reducing agent and an inert metal (III) complex oxidizing agent, said inert metal (III) complex consisting of Lewis bases and a Lewis acid, said oxidizing agent and said reducing agent being so chosen that (1) they undergo redox reaction in a liquid medium in the presence of a catalytic material which is a zero valent metal, (2) the reaction products of said redox reaction are noncatalytic for said redox reaction, and (3) when test samples thereof are each dissolved in an inert solvent at a concentration of about 0.01 molar at 20° C., there is essentially no redox reaction between said oxidizing agent and said reducing agent, and said oxidizing agent being a complex of a metal ion with a ligand which, when a test sample thereof is dissolved at 0.1 molar concentration at 20° C. in an inert solvent solution containing a 0.1 molar concentration of a tagged ligand of the same species which is uncoordinated, exhibits essentially no exchange of uncoordinated and coordinated ligands for at least 1 minute.

6. A processing composition as defined in claim 5 wherein said oxidizing agent is a cobalt complex having a coordination number of 6 and comprising a ligand selected from the group consisting of ethylenediamine, diethylenetriamine, triethylenetetraamine, amine, nitrate, nitrite, azide, chloride, thiocyanate, isothiocyanate, water and carbonate, said complex comprising (a) at least two ethylenediamine ligands or (b) at least five amine ligands or (c) at least one triethylenetetraamine ligand.

7. A processing composition as defined in claim 6 wherein said reducing agent is a photographic aromatic primary amino color-developing agent.

8. An aqueous processing composition comprising a reducing agent and an inert cobalt(III) complex oxidizing agent which undergo redox reaction in the presence of a catalytic material which is a zero valent metal, said reducing agent and said oxidizing agent being so chosen that the reaction products thereof are noncatalytic for said redox reaction, said cobalt complex having a coordination number of 6 and comprising a ligand selected from the group consisting of ethylenediamine, diethylenetriamine, triethylenetetraamine, amine, nitrate, nitrite, azide, chloride, thiocyanate, isothiocyanate, water and carbonate, said complex comprising (a) at least two ethylenediamine ligands or (b) at least five amine ligands or (c) at least one triethylenetetraamine ligand.

9. A processing composition according to claim 8 wherein said cobalt(III) complex is a cobalt(III) hexammine.

10. An aqueous processing composition comprising a reducing agent and an inert cobalt(III) complex oxidizing agent which undergo redox reaction in the presence of a catalytic material which is a zero valent metal, said reducing agent and said oxidizing agent being so chosen that (1) the reaction products thereof are noncatalytic for said redox reaction and (2) when test samples thereof are each dissolved in an inert solvent at a concentration of about 0.1 molar at 20° C., there is essentially no redox reaction between said oxidizing agent and said reducing agent, and said oxidizing agent being a complex of a metal ion with a ligand which, when a test sample thereof is dissolved at 0.1 molar concentration at 20° C. in an inert solvent solution containing a 0.1 molar concentration of a tagged ligand of the same species which is uncoordinated, exhibits essentially no exchange of uncoordinated and coordinated ligands for at least 1 minute.

11. A processing composition according to claim 10 wherein said composition contains a chelating agent for reduced cobalt complexes.

* * * * *

UNITED STATES PATENT AND TRADEMARK OFFICE

CERTIFICATE OF CORRECTION

PATENT NO. : 3,989,526

DATED : November 2, 1976

INVENTOR(S) : Vernon Leon Bissonette

It is certified that error appears in the above-identified patent and that said Letters Patent are hereby corrected as shown below:

Column 6, line 22, " inert " should read --"inert"--; line 24, "wellknown" should read --well-known--. Column 7, line 5, "hexamine" should read --hexammine--; line 36, "chosed" should read --chosen--. Column 8, line 36, "borohydriedes" should read --borohydrides--. Column 9, line 45, "suitiable" should read --suitable--. Column 11, line 55, "oxidizing" should read --oxidized--. Column 16, lines 29-30, "dithioante" should read --dithionate--. Column 17, line 47, "o.1 g." should be in the column further right directly beneath "20.0 g.". Column 18, lines 6-7, "silver-pulse-dye" should read --silver-plus-dye--; line 37, that part of formula reading "4amino" should read --4-amino--; line 54, "an" (first occurrence) should read --and--. Column 20, line 13, "$[Co(en_2(SCN)_2]^{+1}$" should read --$[Co(en)_2(SCN)_2^{+1}$--. Column 23, line 33, "90" should be in the column further right directly under "2", and the "g." which it replaces should be further right directly beneath another "g."; line 50, "colordeveloper" should read --color-developer--. Column 26, line 43, "shown" should read --show--. Column 27, lines 53-54, "internalimage" should read --internal-image--. Column 31, line 44, "liquid" should read --ligand--.

Signed and Sealed this

Twenty-ninth Day of March 1977

[SEAL]

*Attest:*

RUTH C. MASON
*Attesting Officer*

C. MARSHALL DANN
*Commissioner of Patents and Trademarks*